US012760455B2

(12) United States Patent
Lund

(10) Patent No.: US 12,760,455 B2
(45) Date of Patent: Oct. 13, 2026

(54) LASER-BONDED NON-WOVEN TEXTILE

(71) Applicant: NIKE, Inc., Beaverton, OR (US)

(72) Inventor: Dallas Lund, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 183 days.

(21) Appl. No.: 18/651,276

(22) Filed: Apr. 30, 2024

(65) Prior Publication Data

US 2024/0368812 A1 Nov. 7, 2024

Related U.S. Application Data

(60) Provisional application No. 63/499,462, filed on May 1, 2023.

(51) Int. Cl.
*D04H 1/55* (2012.01)
*D04H 1/4374* (2012.01)
(Continued)

(52) U.S. Cl.
CPC ..... *D04H 1/559* (2013.01); *D04H 1/4374* (2013.01); *D04H 1/43828* (2020.05);
(Continued)

(58) Field of Classification Search
CPC .. D04H 1/559; D04H 1/4374; D04H 1/43828; D04H 1/43835; D04H 1/5412;
(Continued)

(56) References Cited

U.S. PATENT DOCUMENTS 4,657,957 A 4/1987 Baumann et al.
5,102,724 A 4/1992 Okawahara et al.
(Continued)

FOREIGN PATENT DOCUMENTS

AU 48933/93 A 1/1994
CN 1050749 A 4/1991
(Continued)

OTHER PUBLICATIONS

International Search Report and Written Opinion received for PCT Patent Application No. PCT/US2024/027139, mailed on Jul. 30, 2024, 14 pages.
(Continued)

*Primary Examiner* — Betelhem Shewareged
(74) *Attorney, Agent, or Firm* — Shook, Hardy & Bacon L.L.P.

(57) ABSTRACT

A nonwoven textile can be treated with a laser to construct bonding structures between fibers of the nonwoven textile. In examples, the nonwoven textile can have fibers including a material that absorbs electromagnetic radiation emitted by a laser. In addition, based on absorbing the electromagnetic radiation, the fibers can soften, and the softened portions of the fibers can contact one or more other fibers of the nonwoven textile. When the softened portions re-solidify (e.g., after removal of the electromagnetic radiation), the re-solidified portions of the fiber can at least partially encapsulate the other fiber(s) to form the bonding structure between the re-solidified portions and the other fiber(s). In some examples, the bonding structure can reduce the likelihood of the fibers that are associated with the bonding structure from migrating through a face of the nonwoven textile and forming pills.

28 Claims, 3 Drawing Sheets

(51) Int. Cl.

| | |
|---|---|
| ***D04H 1/4382*** | (2012.01) |
| ***D04H 1/541*** | (2012.01) |
| ***D04H 1/558*** | (2012.01) |
| ***D04H 1/559*** | (2012.01) |
| ***D04H 1/74*** | (2006.01) |

(52) U.S. Cl.
CPC ..... *D04H 1/43835* (2020.05); *D04H 1/5412* (2020.05); *D04H 1/558* (2013.01); *D04H 1/74* (2013.01); *D10B 2401/061* (2013.01); *D10B 2501/00* (2013.01)

(58) Field of Classification Search
CPC .... D04H 1/558; D04H 1/74; D10B 2401/061; D10B 2501/00
USPC ..... 428/109
See application file for complete search history.

(56) References Cited

U.S. PATENT DOCUMENTS

| | | | | |
|---|---|---|---|---|
| 5,252,158 | A | 10/1993 | Shimizu et al. | |
| 5,288,348 | A | 2/1994 | Modrak | |
| 5,993,586 | A | 11/1999 | Dunson et al. | |
| 7,722,743 | B2 | 5/2010 | Best et al. | |
| 8,138,449 | B2 | 3/2012 | Matsuo et al. | |
| 8,172,970 | B2 | 5/2012 | Sussmann | |
| 8,415,007 | B2 | 4/2013 | Honma et al. | |
| 9,192,212 | B2 | 11/2015 | Tateishi et al. | |
| 9,248,622 | B2 | 2/2016 | Määttä et al. | |
| 9,642,751 | B2 | 5/2017 | Imai et al. | |
| 9,765,481 | B2 | 9/2017 | Malmquist et al. | |
| 9,903,070 | B2 | 2/2018 | Mourad et al. | |
| 10,800,349 | B2 | 10/2020 | Nakagawa | |
| 10,981,095 | B2 | 4/2021 | Konishi | |
| 2002/0164465 | A1 | 11/2002 | Curro et al. | |
| 2003/0119394 | A1* | 6/2003 | Ranganathan | A61L 15/60 442/79 |
| 2003/0119413 | A1 | 6/2003 | Chakravarty et al. | |
| 2005/0003721 | A1 | 1/2005 | Greulich et al. | |
| 2006/0286362 | A1 | 12/2006 | Kubota | |
| 2007/0123131 | A1 | 5/2007 | Nguyen et al. | |
| 2010/0075120 | A1 | 3/2010 | Gustafsson et al. | |
| 2010/0093241 | A1 | 4/2010 | Medoff | |
| 2011/0311795 | A1 | 12/2011 | Bartl et al. | |
| 2012/0157904 | A1* | 6/2012 | Stein | D04H 1/49 427/430.1 |
| 2013/0034680 | A1 | 2/2013 | Manninen | |
| 2016/0175751 | A1 | 6/2016 | Chhabra et al. | |
| 2016/0175754 | A1 | 6/2016 | Morison et al. | |
| 2017/0043567 | A1 | 2/2017 | Gubler et al. | |
| 2018/0079142 | A1 | 3/2018 | Kinzelmann et al. | |
| 2020/0157734 | A1 | 5/2020 | Creighton et al. | |
| 2022/0275580 | A1 | 9/2022 | Eberhardt | |
| 2022/0282402 | A1 | 9/2022 | Kobayashi et al. | |
| 2023/0366138 | A1 | 11/2023 | Lund et al. | |
| 2024/0099521 | A1 | 3/2024 | Erlandsson et al. | |
| 2024/0368812 | A1* | 11/2024 | Lund | D04H 1/43835 |
| 2024/0399095 | A1 | 12/2024 | Gilbert et al. | |

FOREIGN PATENT DOCUMENTS

| | | | |
|---|---|---|---|
| CN | 1940161 | A | 4/2007 |
| CN | 101798726 | A | 8/2010 |
| CN | 107106951 | A | 8/2017 |
| CN | 107106957 | A | 8/2017 |
| CN | 108348372 | A | 7/2018 |
| CN | 108713077 | A | 10/2018 |
| CN | 114245833 | A | 3/2022 |
| CN | 114450444 | A | 5/2022 |
| CN | 220564848 | U | 3/2024 |
| DE | 3807859 | A1 | 9/1989 |
| DE | 10200208 | A1 | 7/2003 |
| EP | 0472942 | A1 | 3/1992 |
| GB | 1463370 | A | 2/1977 |
| JP | 50-094288 | A | 7/1975 |
| JP | 2019-019430 | A | 2/2019 |
| WO | 2012/114831 | A1 | 8/2012 |
| WO | 2016/092208 | A1 | 6/2016 |
| WO | 2017/168172 | A1 | 10/2017 |
| WO | 2019/095423 | A1 | 5/2019 |
| WO | 2021/058536 | A1 | 4/2021 |
| WO | 2022/093594 | A2 | 5/2022 |
| WO | 2023/224977 | A1 | 11/2023 |
| WO | 2024/229064 | A1 | 11/2024 |

OTHER PUBLICATIONS

"Laser Joining Fabrics Improves Productivity", Laser Focus World, Available online at <https://www.laserfocusworld.com/industrial-laser-solutions/article/14216338/laser-joining-fabrics-improves-productivity>, Jan. 1, 2005, 11 pages.

International Preliminary Report on Patentability received for PCT Patent Application No. PCT/US2023/022360, mailed on Nov. 28, 2024, 9 pages.

Mcgrath, Gareth, "Improving Productivity and Quality With Laser Seaming of Fabrics", Fibre 2 Fashion, Available online at <https://www.fibre2fashion.com/industry-article/1368/improving-productivity-and-quality-with-laser-seaming-of-fabrics>, Accessed on Mar. 3, 2021, Jan. 2007, 4 pages.

Non-Final Office Action received for U.S. Appl. No. 18/197,626, mailed on May 2, 2025, 9 pages.

Notice of Allowance received for U.S. Appl. No. 18/197,626, mailed on Nov. 24, 2025, 2 pages.

Notice of Allowance received for U.S. Appl. No. 18/197,626, mailed on Sep. 3, 2025, 8 pages.

Notice of Allowance received for U.S. Appl. No. 18/197,626, mailed on Sep. 12, 2025, 2 pages.

Vasquez, Joshua, "Defocused Laser Welding Fabric Proves There's Many Ways to Slice It", Hackaday, Available online at: <https://hackaday.com/2020/04/27/defocused-laser-welding-fabric-proves-theres-many-ways-to-slice-it/>, Apr. 27, 2020, 7 pages.

Wang et al., "Performance and Applications of Coconut Shell Fiber and Coconut Charcoal Fiber", Advances in Textile Technology, Issue 02, Feb. 25, 2020, 3 pages.

* cited by examiner

LASER-BONDED NON-WOVEN TEXTILE

CROSS-REFERENCE TO RELATED APPLICATIONS

This application claims the priority benefit of U.S. Patent Application No. 63/499,462 (filed May 1, 2023), which is hereby incorporated by reference in its entirety.

TECHNICAL FIELD

Examples of this disclosure relate to bonding structures (e.g., formed using electromagnetic energy emitted by a laser) within a textile (e.g., for wearable articles of apparel), the bonding structures being configured to reduce the likelihood of pilling.

BACKGROUND

Nonwoven textiles are generally formed using fibers, and fiber ends may migrate through a face of the nonwoven and entangle with other fiber ends to form pills. In some instances, pilling may be reduced by treating the face of the nonwoven with different processes such as calendaring and/or with different materials including adhesive-type materials to adhere together the fiber ends. The all-over surface treatment may impact the face of nonwoven by, for example, potentially reducing the softness or hand of the nonwoven and also may impact the drapability of the nonwoven. This may be less than desirable when the nonwoven is used in articles of apparel where a soft hand and drapability are desirable characteristics.

DETAILED DESCRIPTION OF DRAWINGS

The present systems and methods for a laser-bonded non-woven textile are described in detail below with reference to these figures.

DETAILED DESCRIPTION

Figure 1:
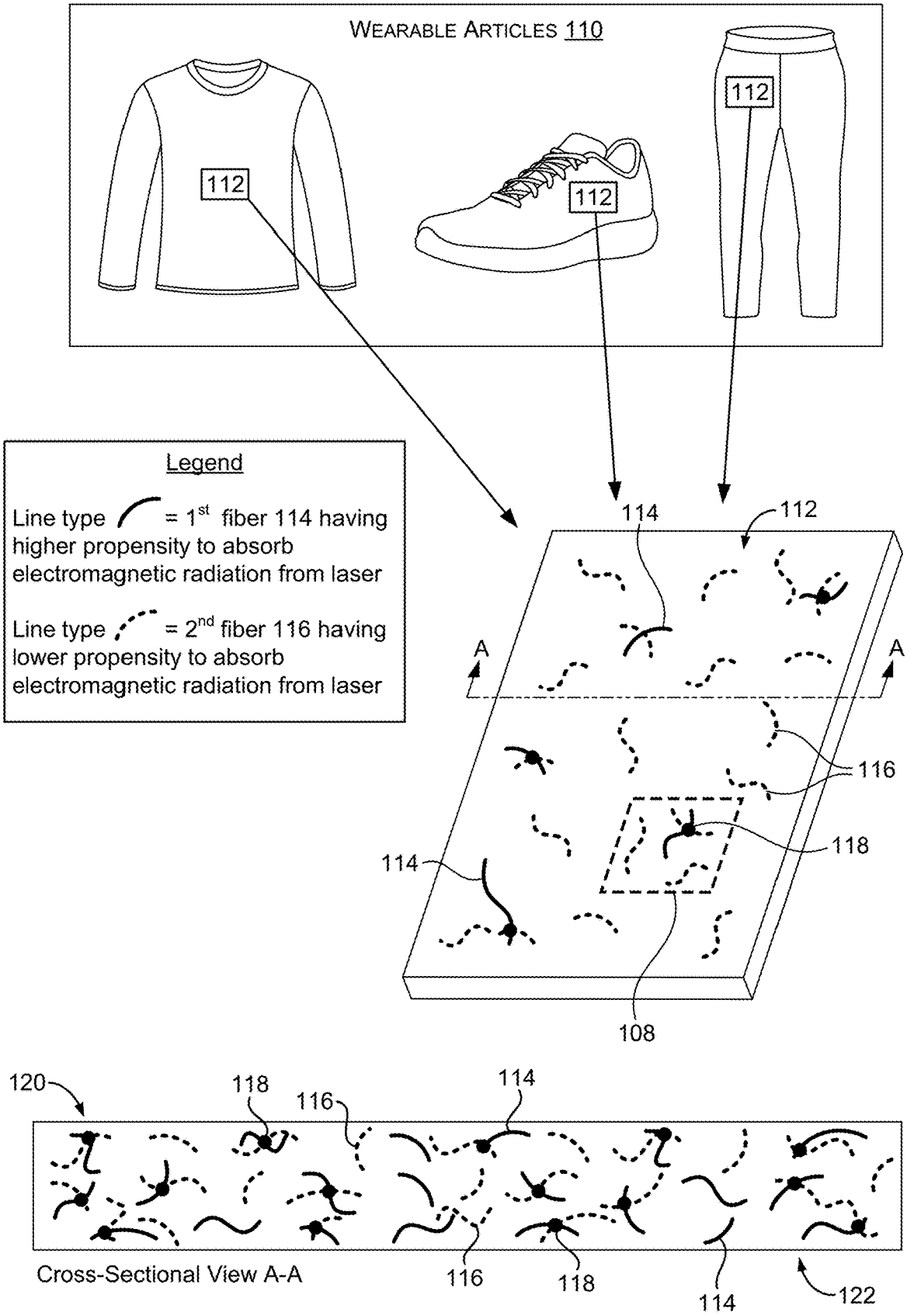
FIG. 1 depicts a wearable article constructed at least partially of a nonwoven textile, in accordance with examples of this disclosure.

This detailed description is related to a nonwoven textile that is exposed to thermal energy (e.g., via a laser) to construct bonding structures between fibers of the nonwoven textile. In examples, the nonwoven textile can have fibers including a material (as referred to herein as an "ERA material") that absorbs electromagnetic radiation emitted by a laser. In addition, based on absorbing the electromagnetic radiation, the fibers can soften, and the softened portions of the fibers can contact one or more other fibers of the nonwoven textile. When the softened portions re-solidify (e.g., after removal of the electromagnetic radiation), the re-solidified portions of the fiber can at least partially encapsulate the other fiber(s) to form the bonding structure between the re-solidified portions and the other fiber(s). In some examples, the bonding structure can reduce the likelihood of the fibers that are associated with the bonding structure migrating through a face of the nonwoven textile and forming pills.

Traditionally pilling can be reduced by treating the face of the nonwoven textile with different processes such as calendaring and/or with different materials including adhesive-type materials to adhere together the fiber ends. However, surface treatment(s) can impact the face of nonwoven by, for example, potentially reducing the softness or hand of the nonwoven and also can impact the drapability of the nonwoven. This can be less than desirable when the nonwoven is used in articles of apparel where a soft hand and drapability are desirable characteristics.

In addition, while some traditional solutions treat nonwoven textiles with electromagnetic radiation (such as with a laser) to form thermal bonds among fibers, the nonwoven textile can have various properties that can reduce the effectiveness for use in wearable articles. For instance, traditional laser-bonding approaches can result in a textile with hand-feel, drape, pilling tendencies, and/or other properties that are undesirable for wearable articles. In some traditional solutions the nonwoven textile does not include a sufficient amount of fibers that absorb electromagnetic radiation, and although some thermal bonding can occur, fibers that are not contained by a bonding structure still form pills. In some traditional solutions, the nonwoven textile does can include too many fibers that absorb electromagnetic radiation, and although thermal bonding can occur, the amount of thermal bonding (e.g., a higher amount of thermal bonding) can negatively impact the hand feel, drape, or other qualities of the textile. In some traditional solutions, the nonwoven textile does not include an effective distribution of fibers (e.g., within the volume or body of the nonwoven textile) that absorb electromagnetic radiation. For example, some traditional nonwoven textiles treated with lasers can include fibers that absorb the electromagnetic radiation mostly towards a first face of the nonwoven textile, without also distributing a sufficient amount of the fibers towards the other second face, which can result in a lower amount of thermal bonding towards the other second face and can impact pilling reduction. This can also result in delamination between layers of the nonwoven textile. In some traditional solutions, fibers can include too much material that absorbs the electromagnetic radiation, such that the fibers are cut by the application of the laser, as opposed to merely softened, and the cut fibers can be less effective at impeding fiber migration (and ultimately pilling). In some traditional solutions, fibers that absorb the electromagnetic radiation can include an orientation (e.g., relative to the machine direction and/or the cross direction) that decreases the likelihood that the fiber forms a bonding structure with other fibers, such where fibers are mostly aligned in a same orientation (e.g., with lower amounts of fiber crisscrossing).

In contrast to traditional solutions, examples of the present disclosure can include a nonwoven textile having an improved distribution of fibers that absorb the electromagnetic radiation.

For example, in some instances the nonwoven textile can include, between a first face and an opposing second face, a fiber web having a homogenous blend of first fibers that have a higher propensity to absorb the electromagnetic radiation and second fibers that have a lower propensity to absorb the electromagnetic radiation. In examples, the homogeneous blend can increase the likelihood of bonding structures (e.g., formed by the first fibers softening and re-solidify to capture other fibers) being more evenly distributed throughout the nonwoven textile.

In some examples, the nonwoven textile can include, between a first face and an opposing second face, a first fiber web and a second fiber web. In examples, each of the first fiber web and the second fiber web can include a homogenous blend of first fibers that have a higher propensity to absorb the electromagnetic radiation and second fibers that have a lower propensity to absorb the electromagnetic radiation. In examples, the homogeneous blend of the first fiber web and the second fiber web can increase the likelihood of bonding structures (e.g., formed by the first fibers softening and re-solidify to capture other fibers) being positioned throughout the nonwoven textile.

In some examples, as between the first fiber web and the second fiber web, the relative amounts of first fibers (e.g., having a higher propensity to absorb the electromagnetic radiation) to second fibers (e.g., having a lower propensity to absorb the electromagnetic radiation) can be substantially similar.

In some examples, as between the first fiber web and the second fiber web, the relative amounts of first fibers (e.g., having a higher propensity to absorb the electromagnetic radiation) to second fibers (e.g., having a lower propensity to absorb the electromagnetic radiation) can be different (e.g., the fiber webs can be asymmetrical based on the relative amounts of first fibers). In some examples, although the first fiber web and the second fiber web can include different relative amounts of first fibers and second fibers, the relative amounts of bonding structures as between the two fiber webs can be more similar. That is, even though the relative amounts can differ by a certain degree, the extent to which there is any difference in the amounts of bonding structures can differ by a lesser degree.

In some examples in which a nonwoven textile includes one or more fiber webs that include first fibers (e.g., having a higher propensity to absorb the electromagnetic radiation) and second fibers (e.g., having a lower propensity to absorb the electromagnetic radiation), in at least one of the fiber webs the relative amounts of first fibers to second fibers (e.g., by weight) can be about 30% (first fibers): 70% (second fibers) or about 25%:75% or about 20%:80% or about 15%:85% or about 10%:90%.

In some examples, after treatment with a laser, the nonwoven textile can include a relatively even distribution of bonding structures between the first face and the opposing second face.

In at least some examples, the first fibers that have a higher propensity to absorb the electromagnetic radiation comprise a first material, which can be referred to in this disclosure as an electromagnetic radiation absorbing (ERA) material. In some examples, the ERA material can include an additive configured to absorb the electromagnetic radiation, and the ERA material can be combined with a second material that is not configured to absorb the electromagnetic radiation or that absorbs the electromagnetic radiation to a lesser extent. In some examples, the second material can transmit or reflect the electromagnetic radiation. As an example, the first material may have a higher propensity to absorb the electromagnetic radiation having a wavelength in a selected wavelength range, while the second material may not absorb the electromagnetic radiation having the wavelength in the selected wavelength range.

The first fibers can include various amounts of the first material (ERA material). For example, in some instances, the first fiber can include an amount of the ERA material (e.g., by weight or by volume of the first fibers) that is about, or less than, 5% of the first fibers, or about, or less than 2.5% of the first fibers. In some examples, this amount of the ERA material is configured to facilitate the first fibers softening and not breaking or being cut by the absorption of the electromagnetic radiation from the laser.

In at least some examples, the nonwoven textile can include a machine direction and a cross direction. In addition, between a first face and an opposing second face, the nonwoven textile can include first fibers that have a higher propensity to absorb the electromagnetic radiation and second fibers that have a lower propensity to absorb the electromagnetic radiation. In examples, the first fibers can include an orientation or angle that is relative to the machine direction and that is in a range of about 30 degrees to about 60 degrees. In some examples, the orientation or the angle can increase the likelihood of the first fibers being contacted by (and absorbing) the electromagnetic radiation. In examples, the second fibers can also include an angle in a range of 30 degrees to about 60 degrees relative to the machine direction. In some instances, the second fibers can include an angle of about 30 degrees to about 60 degrees relative to the first fibers. The angles of the first fibers and the second fibers can also increase the likelihood of the second fibers being encapsulated by re-solidified portions of the first fibers.

In at least some examples, a distribution of bonding structures (e.g., comprising re-solidified first fibers and second fibers) among the composite nonwoven textile can impart desired properties. For example, in some instances, the composite nonwoven textile can include bonding structures throughout the thickness of the textile. In some examples, the bonding structures can be relatively symmetrical, based on size, shape, etc. In some examples, the bonding structures can be relatively asymmetrical. For example, in some examples, bonding structures closer to one face can include a flatter or more elongated form, whereas bonding structures closer to the other face can be more bulbous. In some examples, bonding structures closer to one face can include more necking (e.g., elongation in a central portion between two end portions) as compared to the bonding structures closer to the other face. In some examples, bonding structures closer to one face can be larger (e.g., based on weight, length, diameter, etc.) as compared to the bonding structures closer to the other face.

In some example, asymmetrical properties of bonding structures can be useful for wearable articles where the composite nonwoven textile can have an innermost face (oriented towards the wearer and/or the wearer's skin) and an outermost face (oriented away from the wearer and towards an environment). For example, larger bonding structures can sometimes be more effective at pilling reduction, but can also affect hand-feel, such that it can be advantageous to position larger bonding structures closer to an outermost face.

In general, the examples of this disclosure can lower the overall carbon footprint of the nonwoven textile and can also improve the recyclability of the textile. For example, using laser bonding to increase resistance to pilling can reduce (in some instances) the need for surface treatments which can improve the recyclability of the textile. In some examples, using laser bonding to create bonds can reduce the need for other operations (e.g., coating, needle punching, etc.), which can reduce the carbon footprint of the textile by avoiding the resource expenditure associated with those other operations.

As used herein, the term "article of apparel" is intended to encompass articles worn by a wearer, which can also be referred to as "wearable articles". Wearable articles can include, among other things, upper-body garments (e.g., tops, t-shirts, pullovers, hoodies, jackets, coats, vests, and the like), lower-body garments (e.g., pants, shorts, tights, capris, unitards, and the like), hats, gloves, sleeves (e.g., arm sleeves, calf sleeves), articles of footwear (e.g., uppers for shoes), and the like. As used herein, the term "finished goods" may include articles of apparel or wearable articles, equipment such as bags, furniture, and other such items. As used herein, the term "roll goods" may include, for example, rolls of textile, scraps or remnants remaining after pieces are cut from rolls, and the like.

The term "inner-facing surface" when referring to the wearable article means the surface that is configured to face mostly towards a body surface of a wearer, and the term "outer-facing surface" means the surface that is configured to face mostly away from the body surface of the wearer and toward an external environment. The term "innermost-facing surface" means the surface closest to the body surface of the wearer with respect to other layers of the wearable article, and the term "outermost-facing surface" means the surface that is positioned furthest away from the body surface of the wearer with respect to the other layers of the wearable article.

Fibers contemplated herein may be formed of a number of different materials (e.g., cotton, nylon and the like) or combinations of one or more different materials, including polymers. In some examples, the polymers can include an olefin or alkene. In some examples, the olefin can include a polyolefin. In some examples, the polyolefin can include polyethylene or polypropylene. In some examples, the material can include polyester, such as polyethylene terephthalate (PET).

The fibers may include virgin fibers (fibers that have not been recycled), and/or recycled fibers. Recycled fibers include "shredded-article fibers" and "re-pelletized-polymer fibers." As used herein, shredded-article fibers include fibers that are direct by-products of shredding a fiber-containing article (e.g., knit, woven, nonwoven, etc.). In some examples, shredded-article fibers may be derived without pelletizing and extrusion through processes that consume less energy, and as such, textiles that incorporate shredded-article fibers may have a lower carbon footprint. Re-pelletized-polymer fibers include fibers that are extruded from pelletized or chipped by-products derived from polymer-containing sources (e.g., polymer-containing bottles or containers; polymer-fiber articles that are knit, woven, nonwoven; roll goods; textile manufacturing scrap; fiber webs at various stages of carding, lapping, pre-needling, and needling; etc.).

In some examples, the fibers can be monofilament, bicomponent, or multicomponent. In some examples, a multicomponent fiber can include side-by-side, sheath core, pie, striped, islands-in-a-sea, and various other configurations. In addition, a fiber can include various cross-section profiles, such as circular, ovular, flat, trilobal, squared, rectangular, polygonal, etc.

When referring to fibers, the term denier or denier per fiber is a unit of measure for the linear mass density of the fiber and more particularly, it is the mass in grams per 9000 meters of the fiber. In one example aspect, the denier of a fiber may be measured using ASTM D1577-07. The dtex of a fiber is the mass of an individual fiber in grams per 10,000 meter of fiber length. The diameter of a fiber may be calculated based on the fiber's denier and/or the fiber's dtex. For instance, the fiber diameter, d, in millimeters may be calculated using the formula: d=square root of dtex divided by 100. In general, the diameter of a fiber has a direct correlation to the denier of the fiber (i.e., a smaller denier fiber has a smaller diameter).

Fibers can have various lengths. In some examples, the fiber length can be in a range from about 30 mm to about 110 mm. In some examples, the fiber length can be shorter than 30 mm or longer than 110 mm. In some instances, shorter fibers can be referred to as staple fibers, while longer fibers can be referred to as filaments.

As used herein, the term "nonwoven textile" refers to a textile having fibers that are held together by mechanical and/or chemical interactions without being in the form of a knit, woven, braided construction, or other structured construction. In a particular aspect, the nonwoven textile includes a collection of fibers that are mechanically manipulated to form a mat-like material. Stated differently nonwoven textiles are directly made from fibers. The nonwoven textile may include different webs of fibers formed into a cohesive structure, where the different webs of fibers may have a different or similar composition of fibers and/or different properties. Non-limiting examples of nonwoven textiles can include staple-fiber nonwovens, spunbond nonwovens, and melt-blown nonwovens.

The term "web of fibers" or "fiber web" refers to a layer of fibers prior to undergoing a mechanical entanglement process with one or more other webs of fibers. The web of fibers includes fibers that have undergone a carding and lapping process that generally aligns the fibers in one or more common directions that extend along an x, y plane and that achieves a desired basis weight. The web of fibers may also undergo a light needling process or mechanical entanglement process that entangles the fibers of the web to a degree such that the web of fibers forms a cohesive structure that can be manipulated (e.g., rolled on to a roller, un-rolled from the roller, stacked, and the like). In examples, a "fiber-web roll good" refers to fibers that have been formed into a cohesive structure (e.g., by carding, lapping, and/or light needling) and rolled onto a core. The web of fibers may also undergo one or more additional processing steps such as printing prior to being entangled with other webs of fibers to form the composite nonwoven textile. The term "entangled web of fibers" when referring to the composite nonwoven textile refers to a web of fibers after it has undergone mechanical entanglement (e.g., needled, water entangled, air entangled, etc.) with one or more other webs of fibers. As such, a web of entangled fibers may include fibers originally present in the web of fibers forming the layer as well as fibers that are present in other webs of fibers that have been moved through the entanglement process into the web of entangled fibers.

Mechanical entanglement processes contemplated herein can include needle entanglement (commonly known as needlepunching) using barbed or structured needles (e.g., forked needles), and/or fluid entanglement. In aspects contemplated herein, needlepunching may be utilized based on the small denier of the fibers being used and the ability to fine tune different parameters associated with the needlepunching process. Needlepunching generally uses barbed or spiked needles to reposition a percentage of fibers from a generally horizontal orientation (an orientation extending along an x, y plane) to a generally vertical orientation (a z-direction orientation). Referring to the needlepunching process in general, the carded, lapped, and pre-needled webs may be stacked with other carded, lapped, and pre-needled webs and other layers such as an elastomeric layer and passed between a bed plate and a stripper plate positioned on opposing sides of the stacked web configuration.

Barbed needles, which are fixed to a needle board, pass in and out through the stacked web configuration, and the stripper plate strips the fibers from the needles after the needles have moved in and out of the stacked web configuration. The distance between the stripper plate and the bed plate may be adjusted to control web compression during needling. The needle board repeatedly engages and disengages from the stacked web configuration as the stacked web configuration is moved in a machine direction along a conveyance system such that the length of the stacked web configuration is needled.

Aspects herein contemplate using multiple needle boards sequentially positioned at different points along the conveyance system where different needle boards may engage the stacked web configuration from different faces of the stacked web configuration (e.g., an upper face and a lower face) as the stacked web configuration moves in the machine direction. Each engagement of a needle board with the stacked web configuration is known herein as a "pass."

Parameters associated with particular needle boards may be adjusted to achieve desired properties of the resulting needled nonwoven textile (e.g., basis weight, thickness, and the like). The different parameters may include stitch density (SD) which is the number of needles per $cm^2$ ($n/cm^2$) used during an entanglement pass and penetration depth (PD) which is how far the needle passes through the stacked web configuration before being pulled out of the stacked web configuration. Parameters associated with the needlepunching process in general may also be adjusted such as the spacing between the bed plate and the stripper plate and/or the speed of conveyance of the stacked web configuration.

Examples of this disclosure contemplate using a barbed needle (a needle having a pre-set number of barbs arranged along a length of the needle) although other needle types are contemplated herein. The barbs on the needle "capture" fibers as the barb moves from a first face to an opposing second face of the stacked web configuration. The movement of the needle through the stacked web configuration effectively moves or pushes fibers captured by the barbs from a location near or at the first face to a location near or at the second face and further causes physical interactions with other fibers helping to "lock" the moved fibers into place through, for example, friction.

It is also contemplated herein that the needles may pass through the stacked web configuration from the second face toward the first face. In example aspects, the number of barbs on the needle that interact with fibers may be based on the penetration depth of the needle. For example, all the barbs may interact with fibers when the penetration depth is a first amount, and fewer than all the barbs may interact with fibers as the penetration depth decreases.

In further example aspects, the size of the barb may be adjusted based on the denier of fibers used in the web(s). For example, the barb size may be selected so as to engage with small denier (e.g. fine) fibers but not with large denier fibers so as to cause selective movement of the small denier fibers but not the large denier fibers. In another example, the barb size may be selected so as to engage with both small denier and large denier fibers so as to cause movements of both fibers through the webs.

After entanglement, the nonwoven textile may include a first face and an opposite second face which both face outward with respect to an interior of the nonwoven textile and comprise the outermost faces of the nonwoven textile. As such, when viewing the nonwoven textile, the first face and the second face are each fully visible. The first face and the second face may both extend along x, y planes that are generally parallel and offset from each other. For instance, the first face may be oriented in a first x, y plane and the second face may be oriented in a second x, y plane generally parallel to and offset from the first x, y plane.

The term "elastomeric layer" as used herein refers to a layer that has stretch and recovery properties (e.g., is elastically resilient) in at least one orientational axis, which includes both a layer having stretch and recovery in a single orientational axis and a layer having stretch and recovery in multiple orientational axes. Examples of an orientational axis include a length direction, a width direction, an x-direction, a y-direction, and any direction angularly offset from a length direction, a width direction, an x-direction, and a y-direction.

The elastomeric layer may be formed from thermoplastic polymers, such as thermoplastic elastomers (TPE). Examples of thermoplastic elastomers can include thermoplastic polyurethane (TPU), thermoplastic polyether ester elastomer (TPEE), combinations of TPU and TPEE and the like. Other examples of thermoplastic elastomers can include styrene block copolymers (TPE-S), thermoplastic polyolefins (TPO), thermoplastic vulcanisates (TPV), and melt processable rubber (MPR), thermoplastic polyether block amides (TPE-A). The elastomeric layer may comprise a spunbond layer, a meltblown layer, a film, a web, a scrim, and the like. In example aspects, the elastomeric layer may include a spunbond TPEE or a meltblown TPU. Nonwoven elastomeric materials such as a spunbond TPEE or a meltblown TPU allow for lower basis weights than elastomeric films. As well, they are generally more breathable and permeable due to the fibrous nature of the web versus a film, and they are generally more pliable (e.g., less stiff) than films. These factors (low basis weight, breathable and permeable, pliable) make them ideal for use in the example composite nonwoven textile described herein especially in the apparel context where these are desirable features.

The term "color" or "color property" as used herein when referring to the nonwoven textile generally refers to an observable color of fibers that form the textile. Such aspects contemplate that a color may be any color that may be afforded to fibers using dyes, pigments, and/or colorants that are known in the art. As such, fibers may be configured to have a color including, but not limited to red, orange, yellow, green, blue, indigo, violet, white, black, and shades thereof. In one example aspect, the color may be imparted to the fiber when the fiber is formed (commonly known as dope dyeing). In dope dyeing, the color is added to the fiber as it is being extruded such that the color is integral to the fiber and is not added to the fiber in a post-formation step (e.g., through a piece dyeing step).

Aspects related to a color further contemplate determining if one color is different from another color. In these aspects, a color may comprise a numerical color value, which may be determined by using instruments that objectively measure and/or calculate color values of a color of an object by standardizing and/or quantifying factors that may affect a perception of a color. Such instruments include, but are not limited to spectroradiometers, spectrophotometers, and the like. Thus, aspects herein contemplate that a "color" of a textile provided by fibers may comprise a numerical color value that is measured and/or calculated using spectroradiometers and/or spectrophotometers. Moreover, numerical color values may be associated with a color space or color model, which is a specific organization of colors that provides color representations for numerical color values, and thus, each numerical color value corresponds to a singular color represented in the color space or color model.

In these aspects, a color may be determined to be different from another color if a numerical color value of each color differs. Such a determination may be made by measuring and/or calculating a numerical color value of, for instance, a first textile having a first color with a spectroradiometer or a spectrophotometer, measuring and/or calculating a numerical color value of a second textile having a second color with the same instrument (i.e., if a spectrophotometer was used to measure the numerical color value of the first color, then a spectrophotometer is used to measure the numerical color value of the second color), and comparing the numerical color value of the first color with the numerical color value of the second color.

In another example, the determination may be made by measuring and/or calculating a numerical color value of a first area of a textile with a spectroradiometer or a spectrophotometer, measuring and/or calculating a numerical color value of a second area of the textile having a second color with the same instrument, and comparing the numerical color value of the first color with the numerical color value of the second color. If the numerical color values are not equal, then the first color or the first color property is different than the second color or the second color property, and vice versa.

Further, it is also contemplated that a visual distinction between two colors may correlate with a percentage difference between the numerical color values of the first color and the second color, and the visual distinction will be greater as the percentage difference between the color values increases. Moreover, a visual distinction may be based on a comparison between colors representations of the color values in a color space or model. For instance, when a first color has a numerical color value that corresponds to a represented color that is black or navy and a second color has a numerical color value that corresponds to a represented color that is red or yellow, a visual distinction between the first color and the second color is greater than a visual distinction between a first color with a represented color that is red and a second color with a represented color that is yellow.

The term "unit area" (e.g., 108 in FIG. 1) can describe a portion of a textile used to assess properties of the textile. In some examples, a unit area can include a 1 cm×1 cm (1 $cm^2$), although other sizes can be used, as necessary or dictated based on the property to be assessed. In some examples, a "unit volume" can be used to asses properties of a textile, and a unit volume can include a 1 cm×1 cm×n, where n is a depth or thickness associated with the textile. In some examples, n is the entire thickness of the textile or is the thickness of a layer within the textile (e.g., the thickness of a fiber web within the textile). Other dimensions of unit volumes can also be used, as necessary or dictated based on the property to be assessed.

The term "homogeneous," as used herein, can describe a fiber and can describe a set of fibers and refers to the quality of having relatively uniform properties. The term "homogeneity" refers to the degree to which a fiber or a set of fibers is homogeneous. Homogeneity can be used to describe a fiber or a fiber web at various stages of processing (e.g., entanglement), such as when the fiber or fiber webs are carded, lapped, pre-needled, entangled with other fiber webs, in a composite nonwoven textile, in a multi-layer pattern piece, in a fiber-web remnant, shredded, re-extruded, and the like. Homogeneity can be based on one or more properties, such as fiber length, denier, diameter, color properties, and chemical composition. Homogeneity can be measured in various manners. In one example, homogeneity can be based on measurements applied to a single fiber. In some examples, homogeneity can describe a blend of fibers (e.g., a homogenous blend of fibers). In one example, homogeneity can be based on a unit area or unit volume of a fiber web.

Homogeneity can be measured in various manners, which can depend on what property is being measured. For example, homogeneity can be determined by analyzing the fibers within a unit area or unit volume to measure one or more properties (e.g., denier, diameter, shape, length, color property, chemical composition, etc.) of the fibers and determining what percentage of fibers include a common property. In some examples, material composition can be based on one or more various known methods of chemical analysis, and homogeneity can be based on what percentage of material within a unit area includes a common chemical composition. Color property can be determined as described in other parts of this disclosure.

In at least some examples, homogeneity (e.g., a degree or relative amount of homogeneity) can be determined based on an average measured parameter in n number of regions of interest (ROI) having a standard deviation equal to, or less than, "X" units of the average value. In some examples, a property can be considered homogenous when the standard deviation is 5.0 or less and can be considered highly homogenous when the standard deviation is 1.0 or less. In at least some examples, n can be at least three or more.

For example, if within a textile (e.g., fiber web, composite nonwoven textile, etc.) four ROIs have a basis weight of 84, 87, 87, and 88, then the average basis weight is 86.5 and the standard deviation is 1.73. In examples, in which homogenous is based on a standard deviation of 5.0 or less, the textile can be deemed homogenous based on basis weight. If the basis weights were 84, 85, 85, and 86, then the average basis weight would be 85, the standard deviation would be 0.82, and where a standard deviation of 1.0 or less indicates highly homogenous, then the textile could be deemed highly homogenous with respect to basis weight.

The term "pill" or "pilling" as used herein refers to the formation of small balls of fibers or fibers ends on a facing side of the nonwoven textile. The pill may extend away from a surface plane of the face. Pills are generally formed during normal wash and wear due to forces (e.g., abrasion forces) that cause the fiber ends to migrate through the face of the nonwoven textile and entangle with other fiber ends. A textile's resistance to pilling may be measured using standardized tests such as Random Tumble and Martindale Pilling tests. The term "pile" as used herein generally refers to a raised surface or nap of a textile consisting of upright loops and/or terminal ends of fibers that extend from a face of the textile in a common direction.

Examples of this disclosure can use lasers to emit electromagnetic radiation that is absorbed by one or more fibers in a nonwoven textile. In general, lasers emit energy in the form of photons having a specific wavelength that is dependent upon the state of an electron's energy when the photon is released. Electromagnetic radiation emitted by a laser is generally monochromatic (i.e., it comprises a specific wavelength), coherent, and directional. In general, the primary wavelengths associated with the electromagnetic radiation fall within the ultraviolet, visible, and infrared regions of the electromagnetic spectrum. For instance, the electromagnetic radiation may have wavelengths between 100 nanometers (nm) and 400 nm (ultraviolet radiation), wavelengths between about 400 nm and 700 nm (visible radiation), and wavelengths between 700 nm and 1 mm (infrared radiation). When describing that a fiber has a propensity to absorb electromagnetic radiation emitted by a laser, it is contemplated herein that the fiber has properties that enable it to absorb electromagnetic radiation of a specified wavelength or wavelength range.

Aspects herein contemplate use of different types of commercially available lasers including laser diodes, continuous wave lasers, gas lasers, solid-state lasers, pulse lasers such as a femto-second-laser, excimer lasers, semiconductor lasers, dye lasers, free electron lasers, and the like. The laser type may include, for example, Argon Fluoride, Xenon Chloride, Xenon Fluoride, Helium Cadmium, Rhodamine 6G, Copper vapor, Argon, Frequency doubled Nd:YAG, Helium Neon, Krypton, Ruby, Laser Diodes, Ti:Sapphire, Alexandrite, Nd:YAG, Hydrogen Fluoride, Erbium:Glass, Carbon Monoxide, Carbon Dioxide, and the like.

In example aspects, parameters associated with a particular laser for use in accordance with aspects herein may be optimized to achieve desired properties in a nonwoven textile. For example, the wavelength emitted by the laser may be selected to cause heating of the electromagnetic radiation absorbing fibers used to form the nonwoven textile. In example aspects, the wavelength range contemplated herein ranges from about 400 nanometers (nm) to about 1070 nm. In further example aspects, the wavelengths contemplated herein include about 450 nm, 532 nm, 650 nm, and 1060 nm. These are just examples, and other wavelengths are contemplated as being within the scope herein. The intensity and/or energy density of the laser may be adjusted to achieve a desired level of penetration of the nonwoven textile. For example, the intensity may be adjusted to penetrate through at least 10%, 20%, 30%, 40%, 50%, 60%, 70%, 80%, 90%, or 100% of the thickness of the nonwoven textile. In example aspects, the intensity may be adjusted such that the electromagnetic radiation emitted by the laser penetrates into the interior volume (e.g., between about 20% to about 80% of the thickness of the nonwoven textile) of the nonwoven textile but does not extend to the face of the nonwoven textile that is opposite of the face to which the electromagnetic radiation is applied. Additional parameters to be adjusted include the duration of application of the electromagnetic radiation to the nonwoven textile. The duration may be selected to achieve a desired softening or melting of fibers without causing overheating of the areas surrounding the affected fibers and/or disrupting the structural integrity of the nonwoven textile. Aspects herein contemplate a duration from about 1 millisecond to about 5 seconds. When the duration is multiplied by the energy density, an overall power density is determined. The beam width of the laser may also be adjusted to produce a selected size or surface area of a laser application site. Aspects herein contemplate a beam width equal to or greater than 1 to 2 mm. This, in turn, may affect the number of bonding structures formed in the nonwoven textile, the spacing between adjacent bonding structures, and the size of the individual bonding structures.

In example aspects, the electromagnetic radiation emitted by the laser may be applied to a nonwoven textile in a predefined pattern to create discrete bonding structures within the nonwoven textile. The pattern may be engineered to create a desired density of bonding structures within different areas of the nonwoven textile. In further example aspects, both the application of the electromagnetic radiation by the laser and the entanglement of the nonwoven textile may be digitized such that, for example, entanglement of the nonwoven textile occurs at areas that are different from the areas of the nonwoven textile where bonding structures are formed (e.g., the areas do not overlap within a particular x, y plane of the nonwoven textile). This may prevent overworking of the nonwoven textile so as to maintain the soft hand and drapability of the nonwoven textile making it ideal for use in articles of apparel.

In some examples, electromagnetic radiation emitted by the laser may be applied to a nonwoven textile in stages or one or more passes or applications. For example, the electromagnetic radiation can be applied in a first phase or pass with the laser having a first combination of laser settings (e.g., beam size, intensity, wavelength, etc.) and then in a subsequent phase or pass with the laser having a second combination of laser settings, which can be the same or different from the first combination of laser settings.

In accordance with aspects herein, when the electromagnetic radiation emitted by a laser is absorbed by a first fiber that has a propensity to absorb the electromagnetic radiation, such as a polymer fiber that comprises carbon black (e.g., is coated or impregnated with carbon black), the radiation absorption causes the first fiber to increase in temperature and, in examples, to become more viscous (e.g., not necessarily flow). In some examples, the first fiber (or at least some portions of the first fiber) can be heated to a glass transition, or higher, and not necessarily melted. In some examples the first fiber is heated to a temperature that is between the glass transition temperatures and the melting temperature. In some examples, a fiber can be heated to a melting temperature. As used herein when describing that a fiber has a propensity to absorb electromagnetic radiation, aspects herein contemplate that the propensity to absorb electromagnetic radiation may be specific to a certain wavelength or a certain wavelength range (e.g., wavelengths in the infrared spectrum, visible spectrum, and/or the ultraviolet spectrum). When the more viscous (e.g., melted and/or softened) first fiber is in contact with an adjacent second fiber that has a lower propensity to absorb the electromagnetic radiation, the more viscous first fiber may at least partially encapsulate portions of the adjacent second fiber. When the more viscous polymer material of the first fiber re-solidifies (e.g., becomes more glassy), a bonding structure is formed that may include an amorphous polymer agglomeration formed from the melted or softened first fiber along with portions of the first fiber and/or the second fiber in a fiber form. The term "fiber form" generally means a structure that has the characteristics of a fiber including a length that is generally greater than a diameter of the fiber, and a relatively constant diameter along the length of the fiber.

In another example, a first fiber formed of material that has a relatively high melting temperature (e.g., high melt fibers) can comprise an ERA material (e.g., such as carbon black). For example, the first fiber can be coated with carbon black, impregnated with carbon black, or otherwise have carbon black combined therewithin. The first fibers (with the carbon black or other ERA material) may be blended or mixed with second fibers formed of a polymer material that has a relatively lower melting temperature (e.g., low melt fibers) and that generally do not absorb the electromagnetic radiation. When the first fibers with the carbon black are exposed to the electromagnetic radiation emitted by a laser, the carbon black may heat up to the point where it melts portions of the adjacent second fibers while the first fiber remains intact. In this example, the bonding structure may include an amorphous polymer agglomeration primarily composed of the re-solidified polymer material of the second fiber and portions of adjacent first fibers and adjacent second fibers in a fiber form.

In yet another example, aspects herein contemplate the use of bicomponent fibers having, for instance, an ERA material positioned in an abutting relationship with a material that has a relatively lower propensity to absorb the electromagnetic radiation (e.g., a material that might reflect the radiation). The bicomponent fibers may be mixed with other fiber types that may have a relatively lower propensity to absorb the electromagnetic radiation. When a laser emits electromagnetic radiation of a specified wavelength or wavelength range, the ERA material of the bicomponent fiber may raise in temperature to the point of glass transition or to the point of melting. The more viscous or melted material may encapsulate or partially encapsulate adjacent fibers having the relatively lower propensity to absorb the electromagnetic radiation. In this example, the bonding structure may include an amorphous agglomeration composed of the re-solidified electromagnetic radiation absorbing material from the bicomponent fiber, the material of the bicomponent fiber that has a relatively lower propensity to absorb the electromagnetic radiation where this material may retain its fiber form, and portions of adjacent non-bicomponent fibers that have the relatively lower propensity to absorb the electromagnetic radiation, where these fibers are also in a fiber form.

Aspects herein contemplate that the fibers having a relatively greater propensity to absorb electromagnetic radiation may comprise any number of known electromagnetic radiation absorbing materials. For example, additives may be imparted to the fibers such as carbon black, and/or other various pigments, including pigments that use porphyrin type compounds, and fillers to enhance the ability of the fibers to absorb electromagnetic radiation. The carbon black and/or the other various pigments and fillers may be intrinsic to the fiber itself (i.e., extruded with the fiber during the fiber formation process) or the carbon black and/or other various pigments and fillers may be applied as a coating that entirely or partially coats the fiber. For example, in some instances the fibers having a relatively greater propensity to absorb electromagnetic radiation are dope-dyed fibers and the additive (e.g., carbon black or some other pigment) is added during the dope-dying process. Examples also contemplate engineering fibers to not absorb electromagnetic radiation such as by the application of non-absorbing colorants. Any and all aspects, and any variation thereof, are contemplated as being within the scope herein.

Various measurements are provided herein with respect to the pre-entangled webs and the resulting composite nonwoven textile. Thickness of the resulting composite nonwoven may be measured using a precision thickness gauge. To measure thickness, for example, the textile may be positioned on a flat anvil and a pressure foot is pressed on to it from the upper surface under a standard fixed load. A dial indicator on the precision thickness gauge gives an indication of the thickness in mm. Basis weight is measured using ISO3801 testing standard and has the units grams per square meter (gsm). Textile stiffness, which generally corresponds to drape is measured using ASTMD4032 (2008) testing standard and has the units kilogram force (Kgf). Fabric growth and recovery is measured using ASTM2594 testing standard and is expressed as a percentage.

The term "stretch" as used herein means a textile characteristic measured as an increase of a specified distance under a prescribed tension and is generally expressed as a percentage of the original benchmark distance (i.e., the resting length or width). The term "growth" as used herein means an increase in distance of a specified benchmark (i.e., the resting length or width) after extension to a prescribed tension for a time interval followed by the release of tension and is usually expressed as a percentage of the original benchmark distance. "Recovery" as used herein means the ability of a textile to return to its original benchmark distance (i.e., its resting length or width) and is expressed as a percentage of the original benchmark distance. Thermal resistance, which generally corresponds to insulation features, is measured using ISO11092 testing standard and has the units of RCT ($M^2$*K/W).

Unless otherwise noted, all measurements provided herein are measured at standard ambient temperature and pressure (25 degrees Celsius or 298.15 K and 1 bar) with the nonwoven textile in a resting (un-stretched) state.

As used herein, the terms "about" and "substantially" mean+/−10% of a given value, such as a linear dimension value (e.g., height, width, etc.) or a weight value. In addition, with respect to an angle or angular dimension, or the terms parallel and perpendicular, the terms "about" and "substantially" mean within 10 degrees. If the "about" or "substantially" is otherwise used, the terms include equivalents of the subject element, where appropriate.

Various examples are described below with reference to the drawings, and the structure, relationship, and/or functioning of examples can, in some instances, be better understood by reference to this detailed description. However, examples associated with the subject matter of this application are not limited to those illustrated in the drawings or explicitly described below. The drawings might not necessarily be to scale. In some instances, for clarity, brevity, and/or simplicity details might have been omitted, which does not preclude the inclusion of those details in association with examples of this disclosure.

Referring now to FIG. 1, FIG. 1 depicts examples of wearable articles 110 that each comprise a composite nonwoven textile 112, which is shown in an enlarged view. In addition, FIG. 1 includes a cross sectional view A-A that shows a cross section of the nonwoven textile 112. In examples, the nonwoven textile can have fibers 114 including a material that absorbs electromagnetic radiation (e.g., ERA material) emitted by a laser. In addition, based on absorbing the electromagnetic radiation (e.g., via laser processing prior to construction into the wearable article 110), re-solidified portions of the fiber 114 can at least partially encapsulate the other fiber(s) 116 to form a bonding structure 118 (e.g., amorphous polymer agglomerates) between the re-solidified portions and the other fiber(s). In some examples, the bonding structure 118 can reduce the likelihood of the fibers (e.g., 114 and 116) that are associated with the bonding structure from migrating through a face of the nonwoven textile and forming pills.

Examples of the present disclosure can include a nonwoven textile having an improved distribution of fibers 114 that absorb the electromagnetic radiation. For instance, the nonwoven textile can include, between a first face 120 and an opposing second face 122, one or more fiber webs, and any one or more of the fiber webs can include a blend of the first fibers 114 that have a higher propensity to absorb the electromagnetic radiation and second fibers 116 that have a lower propensity to absorb the electromagnetic radiation. In some examples, the blend can include a homogeneous blend, which can increase the likelihood of bonding structures (e.g., formed by the first fibers softening and re-solidify to capture other fibers) being positioned throughout the nonwoven textile.

In accordance with at least some examples, the cross-sectional view A-A is not necessarily meant to precisely depict layering that could exist in association with the composite nonwoven textile, such as layering that might be apparent from or associated with the entanglement of one or more layers. Rather, the cross-sectional view A-A includes an example in which, as compared with more traditional solutions, the first fibers 114 (and the resulting bonding structures) are more evenly distributed between the faces 120 and 122, as opposed to being positioned mainly in a central region (e.g., around the midline between the faces 120 and 122). In examples, the nonwoven textile 112 can include a single fiber web, multiple fiber webs, and/or one or more other textile layers (e.g., other nonwoven textiles, films, knits, wovens, etc.).

Figure 2:
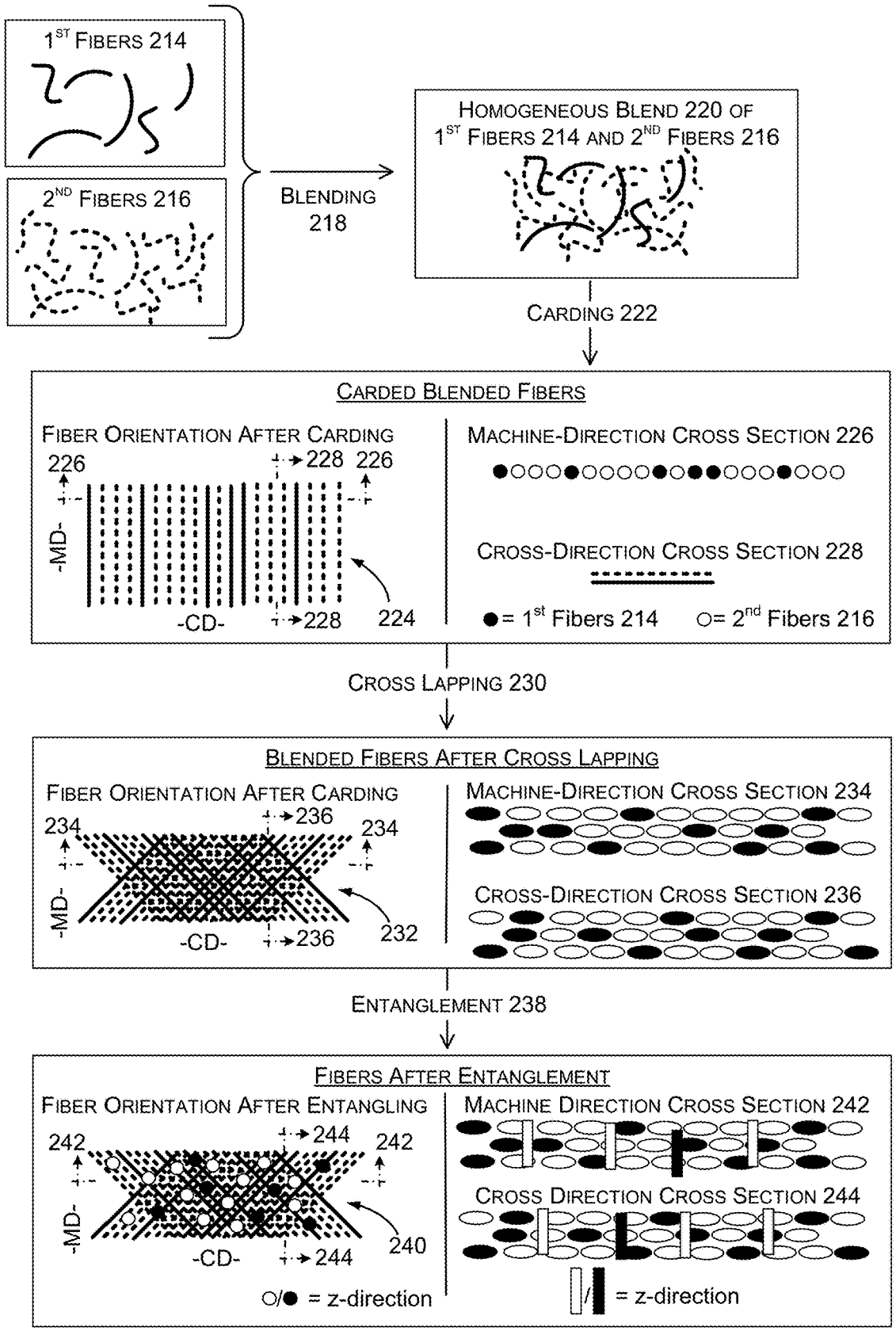
FIG. 2 depicts operations and structures associated with stages of making a nonwoven textile, in accordance with examples of this disclosure.

A nonwoven textile having properties conducive to improved laser treatment (e.g., resulting in more evenly distributed bonding structures between faces) can be manufactured in various manners. Referring to FIG. 2, a series of operations are represented, as well as fiber-related structures that can be associated with the operations. In examples, the fiber-related structures that are illustrated are schematic in nature and are not necessarily intended to depict precise representations of actual fibers or layers of fibers within a structure. For example, the cross-lapped fibrous mat 232 is schematically depict with three layers of fibers, and in examples, the cross-lapped fibrous mat 232 can include more than three layers.

In some examples, operations can include a collection of first fibers 214 and a collection of second fibers 216. For example, the first fibers 214 and the second fibers can include bales of fibers that are subject to a bale opening process (e.g., via a carding willow).

In at least some examples, the first fibers 214 (as compared to the second fibers 216), comprise a higher amount of an ERA material (e.g., having a propensity to absorb electromagnetic radiation emitted by a laser). In some examples, the material having the propensity to absorb the electromagnetic radiation is an additive (e.g., carbon black or some other pigment) that is combined with a polymer. The additive can include a coating, impregnation, backbone, co-extrusion, etc.

In some examples, the material (e.g., the additive) having the propensity to absorb the electromagnetic radiation is combined with the polymer by a dope-dye process, such that the polymer is impregnated with the material.

The first fibers 214 can include various amounts (e.g., by weight and/or by volume) of the ERA material. In some examples, the first fibers 214 can include about 10% or less of the material. In some examples, the fibers 214 can include about 5% or less of the material. In some examples, the fibers 214 can include about 2.5% or less of the material. In some examples, the fibers 214 can include about 1.25% or less of the material. In at least some examples, the amount of the material can impact the state change (e.g., physical state change, such as transitioning to a more viscous state) associated with the first fibers 214 when treated with a laser. For example, fibers compositionally comprising higher amounts of the material having the propensity to absorb the electromagnetic radiation can be more likely (as compared with fibers having lower amounts of the material) to break, tear, or split into multiple fibers or other structures when treated with the laser (e.g., on account of the fiber absorbing more heat and transitioning to a lower viscosity state that is more flowable and easier to split).

The amount of the ERA material (having the propensity to absorb the electromagnetic radiation) in the fiber can be controlled, determined, or measured in various ways. In at least some examples, the amount can be by weight and based on a recipe followed when dope-dyeing the fiber (e.g., n kg of the material is added to n'kg of a polymer). In at least some examples, the amount can be determined by chemical analysis of the fibers.

The first fibers 214 can include a polymer that is mixed with the material having the propensity to absorb the electromagnetic radiation. In at least some examples, the polymer comprising the first fibers 214 can include a low melt polymer (e.g., lower melt temperature than a material compositionally forming the second fibers). In at least some examples, the polymer can include a high melt polymer (e.g., higher melt temperature than a material compositionally forming the second fibers). In at least some examples, the polymer can include a polyester or polyolefin. In at least some examples, the polymer can include polypropylene, polyethylene, polyester, or polyethylene terephthalate (PET). In at least some examples, the first fibers 214 can include any other materials described in this disclosure, or equivalents thereof.

In at least some examples, the first fibers 214 with the ERA material can include a monofilament, bicomponent fiber, or multicomponent fiber. In some examples, a multi-component fiber can include side-by-side, sheath/core, pie, striped, islands-in-a-sea, and various other configurations. In addition, a fiber can include various cross-section profiles, such as circular, ovular, flat, trilobal, squared, rectangular, polygonal, etc. In some examples, a multi-component fiber can comprise, for instance, a first part and a second part in an abutting relationship (e.g., core/sheath), and the first part can comprise the material having a higher propensity to absorb electromagnetic radiation, while the second part can omit the ERA material.

In some examples, the first fibers 214 can include a core/sheath bicomponent fiber, in which at least one of the core and the sheath comprise ERA material. In one example of the bicomponent fiber comprising the ERA material (in at least one of the core and the sheath), the core can include a low-melt material and the sheath can include a high-melt material; the core can include a high-melt material and the sheath can include a low-melt material; the core can include a low-melt material and the sheath can include a low-melt material; and the core can include a high-melt material and the sheath can include a high-melt material.

In examples, as compared to the first fibers 214, the second fibers 216 can include lower amounts (e.g., no amounts) of the material having the propensity to absorb the electromagnetic radiation. In addition, the second fibers can include a polymer.

In at least some examples, the polymer in the second fibers 216 can include a high melt polymer (e.g., higher melt temperature than a material compositionally forming the first fibers 214). In at least some examples, the polymer in the second fibers 216 can include low melt polymer (e.g., lower melt temperature than a material compositionally forming the first fibers). In at least some examples, the polymer can include a polyester or polyolefin. In at least some examples, the polymer can include polypropylene, polyethylene, polyester (e.g., polyethylene terephthalate (PET)). In at least some examples, the first fibers 214 can include any other materials described in this disclosure, or equivalents thereof.

In at least some examples, the first fibers 214 and the second fibers 216 are blended 218 (e.g., by being fed into a mixing chamber). In addition, in some instances, the first fibers 214 and the second fibers 216 are combined into a blend 220 (e.g., a homogenous blend) of the first fibers 214 and the second fibers 216. In some examples, the blend can include other types of fibers.

In at least some example, the blend 220 can include various relative amounts of the first fibers 214 and the second fibers 216, such as by weight. For example, in some instances, the blend 220 can include about 30% first fibers to about 70% second fibers; or about 25% first fibers to about 75% second fibers; or about 20% first fibers to about 80% second fibers; or about 15% first fibers to about 85% second fibers; or about 10% first fibers to about 90% second fibers; or about 5% first fibers to about 95% second fibers.

In at least some examples, the relative amount of the first fibers 214 in the blend can impact at least some properties of a nonwoven textile that is treated with a laser. For example, if the relative amount of the first fibers 214 is too high, then the nonwoven textile can tend to have a quantity of bonding structures on the face of the nonwoven textile that can contribute to a less desirable hand-feel. In some examples, if the relative amount of the first fibers 214 is too low, then the nonwoven textile can tend to have a quantity of bonding structures on the face of the nonwoven textile that can be less effective at reducing pilling.

In at least some examples, the blend 220 of first fibers 214 and second fibers 216 is carded 222 (e.g., via a carding machine) to form a fibrous mat 224 in which the first fibers 214 and the second fibers 216 are generally aligned in a same orientation (e.g., extending lengthwise in the machine direction (MD)). In addition, the fibrous mat 224 can include a machine-direction cross section 226 and a cross-direction cross section 228.

In at least some examples, the fibrous mat 224 comprising first fibers 214 and second fibers 216 is cross lapped 230 (e.g., via a cross-lapping machine) to form a cross-lapped fibrous mat 232 in which the first fibers 214 and the second fibers 216 are generally angled relative to the machine direction. In addition, the cross-lapped fibrous mat 232 can include a machine-direction cross section 234 and a cross-direction cross section 236. In at least some examples, the a cross-lapped fibrous mat 232 can comprise a homogeneous blend of first fibers 214 and second fibers 216 distributed between the opposing faces of the needled web. In at least some examples, the cross-lapped fibrous mat 232 can include first fibers 214 and second fibers 216 that are oriented at an angle, relative to the machine direction. In some examples, the angle is in a range between about 30 degrees and about 60 degrees. In some examples, the angle is about 45 degrees. The angle can be determined in various manners, and in some examples, the angle can be based on an average angle of fibers in a unit area (e.g., on a face of the cross-lapped fibrous mat 232).

In at least some examples, the cross-lapped fibrous mat 232 comprising first fibers 214 and second fibers 216 is entangled 238 (e.g., via needle entanglement, hydro-entanglement, or some other form of mechanical entanglement) to form an entangled fiber web 240. In addition, the entangled fiber web 240 can include a machine-direction cross section 242 and a cross-direction cross section 244. In some examples, the first fibers 214 and the second fibers 216 are generally angled relative to the machine direction, and some fibers can extend at least partially in a z-direction. In at least some examples, the angle of the fibers (e.g., the first fibers 214) relative to the machine direction is in a range of about 30 degrees to about 60 degrees. In some examples, the angle can be about 45 degrees. The angle can be determined in various manners, and in some examples, the angle can be based on an average angle of fibers in a unit area (e.g., on a face of the cross-lapped fibrous mat entangled fiber web 240). In at least some examples, the entangled fiber web 240 can comprise a homogeneous blend of first fibers 214 and second fibers 216 distributed between the opposing faces of the entangled fiber web 240.

In some examples, the entangled fiber web 240 can be a pre-needled web, such as for combining with one or more other textile layers. In some instances, operations associated with the entangling 238 can include needle punching from one side or face of the needled web 240. Once the entangled fiber web 240 is formed, in some instances the entangled fiber web 240 can be coupled to one or more other nonwoven textile layers. Combining with one or more other nonwoven textile layers can include stacking the entangled fiber web 240 with the one or more other nonwoven textile layers (e.g., other fibers webs) and further entangling the stack of layers, such as with multiple passes of needles and/or from both sides of the stack of layers.

In at least some examples, one or more of the various nonwoven fiber arrangements described in association with FIG. 2 can include a homogenous blend of first fibers 214 and second fibers 216. That is, the carded fibrous mat 224, the cross-lapped fibrous mat 232, and/or the entangled fiber web 240 can be associated with a homogenous blend. Homogeneity can be assessed in various manners. In some examples, homogeneity can be assessed by measuring a first blend (e.g., by weight) of first fibers and second fibers in a first unit area (e.g., on a face) or in a first unit volume, measuring a second blend (e.g., by weight) of first fibers and second fibers in a second unit area (e.g., on the same face or on an opposing face) or in a second unit volume, and determining whether the first blend and the second blend is within a threshold. In some examples, the threshold can be based on an industry standard, such as when there is a blend tolerance specified or commonly used by ordinary skilled artisans. In some examples, the tolerance can be about +/−10%.

In at least some examples of the present disclosure, the first fibers 214 are exposed to electromagnetic radiation, such as from a laser source, which can form bonding structures including amorphous polymer agglomeration. The first fibers 214 can be exposed at one or more various stages of the operations associated with FIG. 2. For example, in some instances, the first fibers 214 can be treated with electromagnetic radiation when the first fibers 214 are arranged in the carded fibrous mat 224. In some examples, the first fibers 214 can be treated with electromagnetic radiation when the first fibers 214 are arranged in the cross-lapped fibrous mat 232. In some examples, the first fibers 214 can be treated with electromagnetic radiation when the first fibers 214 are arranged in the entangled fiber web 240. In some examples, the first fibers 214 can be treated with electromagnetic radiation when the first fibers 214 are arranged in the entangled fiber web 240 combined with one or more other layers (e.g., one or more other fiber webs). In examples, the first fibers 214 can be treated with electromagnetic radiation when the first fibers 214 are arranged in any one or more of these nonwoven fiber arrangements.

In examples, the electromagnetic radiation can be applied in various patterns. In some examples, the electromagnetic radiation can be applied to overlapping application sites, which can increase the likelihood of the electromagnetic radiation reaching fibers. In some examples, the electromagnetic radiation can be applied in a pattern that includes spaced-apart application sites.

In some examples, electromagnetic radiation emitted by the laser may be applied to a nonwoven textile in stages or one or more passes or applications. For example, the electromagnetic radiation can be applied in a first phase or pass with the laser having a first combination of laser settings (e.g., beam size, intensity, wavelength, etc.) and then in a subsequent phase or pass with the laser having a second combination of laser settings, which can be the same or different from the first combination of laser settings. In at least some examples, the first phase or pass can include an application to a larger surface area (e.g., substantially all of a face), and a subsequent phase or pass can include application of the electromagnetic radiation to a smaller amount of the face (e.g., in a pattern of non-overlapping application sites).

Figure 3:
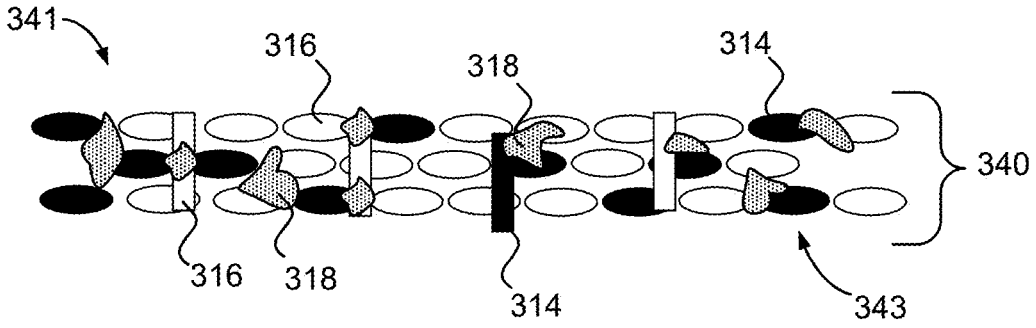
FIG. 3 depicts a cross section of a fiber web with bonding structures, in accordance with examples of this disclosure.

FIG. 3 depicts an entangled fiber web 340 after being exposed to electromagnetic radiation associated with a laser. In some examples, the entangled fiber web 340 is exposed to electromagnetic radiation while isolated from other textile layers (e.g., in a pre-needled form before being combined with other textile layers; where the entangled fiber web 340 includes a discrete nonwoven textile not necessarily combined with other textile layers, etc.). In other examples, the entangled fiber web 340 can be treated with electromagnetic radiation a while combined with other textile layers (e.g., via entanglement, lamination, chemical bonding, etc.).

In example aspects, the electromagnetic radiation is directed initially through the respective first face 341 of the entangled fiber web 340. As described, at least portions of the first fibers 314 absorb the electromagnetic radiation at the application sites which can cause a rise in temperature associated with the first fiber (e.g., of the polymer material forming the first fibers 314). In some examples, the temperature is increased to about the glass transition temperature. In some examples, the temperature is elevated above the glass transition or between the glass transition and melting temperature. In some examples, the temperature is elevated to about the melting temperature. In some examples, the temperature is increased past the melting temperature. Once the viscosity is increased (e.g., the first fiber has softened or melted), the polymer material of the first fibers 314 may come into contact with and/or wet portions of other fibers that are in contact with the more viscous polymer material including portions of adjacent second fibers 316 and portions of adjacent first fibers 314. When the polymer fiber is no longer subjected to the electromagnetic energy, the temperature of the polymer material of the first fibers 314 can lower and the polymer material can re-solidify (e.g., become more glassy), which can form a bonding structure 318 that includes an amorphous polymer agglomeration that partially or fully encapsulates portions of the first fibers 314 and/or the second fibers 316 that have been wetted by the melted polymer material. Portions of the first fibers 314 and/or the second fibers 316 can maintain a fiber form. Thus, fibers can extend from the amorphous polymer agglomeration.

In at least some examples, a result of the bonding structures 318 is to reduce the number of free fiber ends at one or more of the first face 341 and the second face 343 by either trapping the fiber ends, or maintaining the fibers in the bonding structure within a fixed position such that the fibers 314 and 316 have a reduced tendency to migrate and form pills on the first face 341 and the second face 343.

In examples, various properties of the fibers 314 and 316 and/or the entangled fiber web 340 can increase the likelihood that a resulting composite nonwoven textile including the entangled fiber web 340 will include good hand feel and/or a lower likelihood of pilling (e.g., after exposure to electromagnetic radiation). In some examples, homogeneity associated with at least part of the entangled fiber web 340 can contributed to desired properties. Homogeneity can be assessed in various manners. In some examples, homogeneity can be assessed by measuring a first blend (e.g., by weight) of first fibers and second fibers in a first unit area (e.g., on a face) or in a first unit volume (e.g., a first ROI), measuring a second blend (e.g., by weight) of first fibers and second fibers in a second unit area (e.g., on the same face or on an opposing face) or in a second unit volume (e.g., second ROI), and determining whether the standard deviation is within a threshold (e.g., 5.0 for homogenous and 1.0 for highly homogenous).

In examples, based at least partially on the homogeneous blend of fibers distributed between the first face 341 and the opposite second face 343, bonding structures can be formed at a variety of different depths relative to the first face 341 and based on an overall thickness of the entangled fiber web 340. For example, some bonding structures can be on the first face 341; some bonding structures can be at about a 10% depth (relative to the overall thickness of the entangled fiber web 340) based on a portion of the bonding structure closest to the first face 341; some bonding structures can be at about a 20% depth; some bonding structures can be at about a 30% depth; some bonding structures can be at about a 40% depth; some bonding structures can be at about a 50% depth; some bonding structures can be at about a 60% depth; some bonding structures can be at about a 70% depth; some bonding structures can be at about a 80% depth; some bonding structures can be at about a 90% depth; some bonding structures can be on the second face 343; and any and all combinations thereof. In at least some examples, bonding structures at a variety of different depths relative to the first face 341 can decrease the likelihood of pilling.

In addition, in examples the entangled fiber web 340 includes a blend of fibers (e.g., based on the respective quantities that are mixed in the blending 218) that is conducive to reduce pilling without creating too many bonding structures, which might otherwise negatively impact hand feel. As previously described, based on the blending 218, the entangled fiber web 340 can include various relative amounts (e.g., by weight) of the first fibers 314 and the second fibers 316. For example, in some instances, the entangled fiber web 340 can include about 30% first fibers 314 to about 70% second fibers 316; or about 25% first fibers 314 to about 75% second fibers 316; or about 20% first fibers 314 to about 80% second fibers 316; or about 15% first fibers 314 to about 85% second fibers 316; or about 10% first fibers 314 to about 90% second fibers 316; or about 5% first fibers 314 to about 95% second fibers 316.

In at least some examples, the entangled fiber web 340 is cross-lapped, such that at least some of the first fibers 314 and at least some of the second fibers 316 are generally angled relative to the machine direction and/or relative to one another. In at least some examples, the angle of the fibers relative to the machine direction is in a range of about 30 degrees to about 60 degrees. In some examples, the angle of the fibers relative to the machine direction is about 45 degrees. In some instances, the angling of the fibers relative to the machine direction and/or relative to one another (e.g., first fibers 314 angled relative to second fibers 316) can increase the likelihood of the first fibers 314 being exposed to the electromagnetic radiation and/or can increase the likelihood of softened first fibers 314 contacting the second fibers 316. For example, as compared with layers of fibers that are all oriented in the same direction (e.g., longitudinal in the machine direction), in the cross section of the entangled fiber web 340, the fibers 314 and 316 are more overlapping and present a wider target (e.g., more ovular) to be contacted by the electromagnetic radiation and/or one another, which can increase the likelihood of the formation of the bonding structures 318. The angle can be determined in various manners, and in some examples, the angle can be based on an average angle of fibers in a unit area (e.g., on a face of the entangled fiber web 340).

In at least some instances, a percentage of the first material (e.g., an additive) having the propensity to absorb the electromagnetic radiation (the ERA material) can impact the state change (e.g., physical state change, such as softening) associated with the first fibers 314 when treated with a laser. As indicated in association with FIG. 2, the first fibers 314 can include, in some examples, about 10% or less of the ERA material. In some examples, the fibers 314 can include about 5% or less of the ERA material. In some examples, the fibers 314 can include about 2.5% or less of the ERA material. In some examples, lower amounts of the first material (e.g., below about 10%, below about 5%, or about 2.5%) can decrease the likelihood of the first fibers 314 necking and potentially breaking when treated with the laser (e.g., on account of the fiber absorbing an amount of heat and transitioning to a lower viscosity state that is more flowable and easier to split or separate).

The bonding structures 318 can include various properties, such as size, shape, and weight. For example, in some instances, the bonding structures 318 can include a size that is based on a length of the bonding structure (e.g., longest portion) and/or a width of the bonding structure (e.g., shortest portion). In some examples, length and width of the bonding structure can be measured using a caliper. In some examples, length and width can be measured under a microscope. In some instances, the bonding structures 318 can include a size that is based on a largest diameter and/or a shortest diameter.

The bonding structures 318 can include a weight. For example, to determine a weight of a bonding structure, the amorphous polymer agglomerate can be separated from any fibers that do not have a portion encapsulated. In addition, with respect to the fibers having at least some portion encapsulated, the non-encapsulated portions can be trimmed, and the remaining amorphous polymer agglomerate can be weighed.

The bonding structures 318 can include a shape, which can be classified based on different characteristics. For example, in some instances, the shape can be more bulbous in nature. In some examples, the shape can be more elongated with at least a portion necking or forming a narrower bride or connection between two larger portions (e.g., dumbbell shaped).

In some examples, the bonding structures 318 distributed among the entangled fiber web 340 can have at least some symmetrical properties. In some examples, the bonding structures 318 distributed among the entangled fiber web 340 can have at least some asymmetrical properties. For instance, in at least some examples, bonding structures that are positioned closer to the face 341 can have a first property, and bonding structures that are positioned closer to the opposing face 343 can have a second property, which is the same property type and has a different measured value (e.g., length, width, diameter, weight, etc.) or classification (e.g., shape). Properties of bonding structures (e.g., when comparing to assess symmetry or asymmetry) can be assessed using various approaches. In some examples, properties within two unit areas and/or two unit volumes can be determined and compared. In some examples, the average or most common properties in a unit area or unit volume can be determined and compared.

In some examples, bonding structures that are positioned closer to the face 341 can have a first length, and bonding structures that are positioned closer to the opposing face 343 can have a second length, which is different from the first length. For example, a first average length (e.g., average longest length) of bonding structures in a unit area and/or a unit volume closer to the face 341 can be determined; a second average length (e.g., average longest length) of bonding structures in a unit area and/or a unit volume closer to the opposing face 343 can be determined; and the first and second average lengths can be compared. In some examples, in the entangled fiber web 340, the first length is longer than the second length, which can result from various factors. For example, in some instances, the first face 341 can be the side oriented towards or facing the laser when the electromagnetic radiation is applied, and the fibers forming the bonding structures closer to the face 341 can sometimes receive more direct energy and/or higher amounts of energy (as compared to the fibers forming the bonding structures closer to the other face 343). As such, the fibers forming the bonding structures closer to the face 341 can in some cases reach a higher temperature and become more viscous (as compared to the fibers closer to the face 343), which can allow the material of the fiber to spread out more when in the more flowable or melted state.

In some examples, the fibers closer to the first face 341 receiving more direct and/or higher amounts of electromagnetic radiation can contribute to asymmetrical shape properties, as compared to the fibers closer to the first face 343. For example, as described above, the fibers forming the bonding structures closer to the face 341 can in some cases reach a higher temperature and become more viscous (as compared to the fibers closer to the face 343). In some cases, this more viscous state can increase the likelihood that the heated fibers might undergo necking, which can include a more central portion becoming elongated and potentially narrower between larger end portions (e.g., forming a dumbbell shape). In contrast, the fibers that are closer to the other face 343 (e.g., exposed to less direct electromagnetic radiation) might be heated to a state that is less viscous than the fibers closer to the face 341, such that the heated fibers expand, but are less likely to neck. As such, the bonding structures closer to the face 343 can be more bulbous in nature, as compared to the bonding structures closer to the face 341.

In some examples, bonding structures that are positioned closer to the face 341 can have a first weight, and bonding structures that are positioned closer to the opposing face 343 can have a second weight, which is different from the first weight. For example, a first average weight (e.g., average weight) of bonding structures in a unit area and/or a unit volume closer to the face 341 can be determined; a second average weight (e.g., average weight) of bonding structures in a unit area and/or a unit volume closer to the opposing face 343 can be determined; and the first and second average weight can be compared. In some examples, in the entangled fiber web 340, the first weight is larger than the second weight, which can result from various factors. For example, in some instances, the first face 341 can be the side oriented towards or facing the laser when the electromagnetic radiation is applied, and the fibers forming the bonding structures closer to the face 341 can sometimes receive more direct energy and/or higher amounts of energy (as compared to the fibers forming the bonding structures closer to the other face 343). In some cases, through direct absorption of the electromagnetic radiation, through conduction, or through other thermal dynamics, larger portions of the first fibers can form the bonding structures (as compared to the portions of the first fibers closer to the other face 343). As such, the bonding structures closer to the face 341 can in some cases include more material from the first fiber (e.g., more material in the amorphous polymer agglomerate), which can contribute to heavier bonding structures.

In some examples, bonding structures 318 that are closer to the face 341 can include a first density of bonding structures (e.g., per unit area or per unit volume); bonding structures 318 that are closer to the opposing second face 343 can include a second density of bonding structures (e.g., per unit area or per unit volume); and the first density can be different from the second density. In some examples, the first density is assessed based on a unit area on a surface of the first face 341, and the second density is assessed based on a unit area on a surface of the second face 343. In at least some examples, the first density is higher than the second density, which can result from various factors. For example, in some instances, the first face 341 can be the side oriented towards or facing the laser when the electromagnetic radiation is applied, and the fibers forming the bonding structures closer to the face 341 can sometimes receive more direct energy and/or higher amounts of energy (as compared to the fibers forming the bonding structures closer to the other face 343).

In some examples, asymmetric properties among the bonding structures 318 can increase usefulness in wearable articles. For example, the first face 341 can be oriented towards an outermost surface of the wearable article and the second face 343 can be oriented towards an innermost surface of the wearable article. As such, properties and performance associated with the first face 341 can be different from (asymmetric as compared to) properties and performance associated with the second face 343. The asymmetry between the bonding structures can contribute to the desired properties. For instance, larger bonding structures and/or a higher density of boning structures can be more desired for faces, surfaces, or portions of the web 340 in which pilling reduction might be more important (e.g., where that part of the web is farther away from a skin surface of a wearer). In addition, smaller bonding structures can be more desired for faces, surfaces, or portions of the web 340 in which hand-feel might be more important (e.g., where that part of the web is closer to a skin surface of a wearer).

In at least some examples, the entangled fiber web 340 can be combined with one or more other textile layers. For example, the entangled fiber web 340 can be combined with one or more other nonwoven layers, films, woven layers, knit layers, etc. In some instances, the entangled fiber web 340 can be exposed to electromagnetic radiation before and/or after being combined with the one or more other textile layers.

Figure 4:
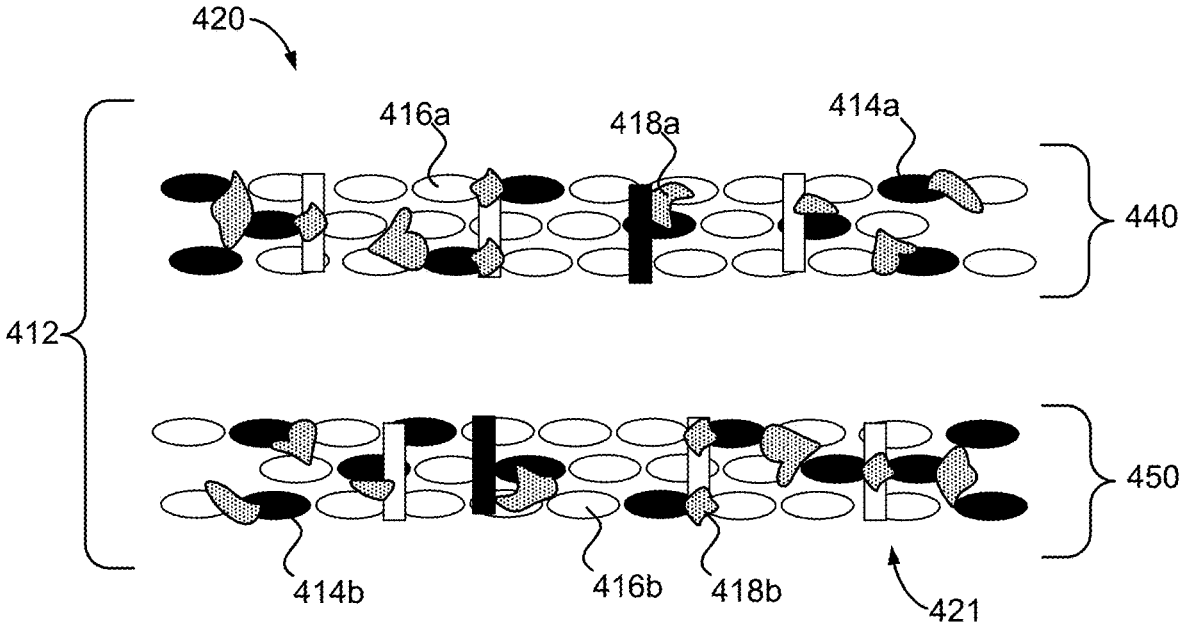
FIG. 4 depicts a cross section of a first fiber web with bonding structures and a second fiber web with bonding structures, in accordance with examples of this disclosure.

In some examples, and referring to FIG. 4, a first fiber web 440 is combined with another fiber web 450, such as in a composite nonwoven textile 412. Although not illustrated in FIG. 4, one or more other textile layers can be positioned between the first fiber web 440 and the second fiber web 450. In addition, or alternatively, one or more other textile layers can be positioned on either side of the first fiber web 440 and the second fiber web 450. In some examples, the fibers webs 440 and 450 are combined by mechanically entanglement. In examples, the composite nonwoven textile 412 can comprise a portion of a wearable article (e.g., 110)

In some examples, the webs 440 and 450 can include at least some entanglement (e.g., have been mechanically entangled) before being combined (e.g., as a pre-needled web). In some examples, the webs 440 and 450 might not have been independently, mechanically entangled before being combined with one another (e.g., both webs 440 and 450 may have been cross-lapped but not needled). In at least some examples, the first web 440 and the second web 450 can be exposed to electromagnetic radiation by a laser before being combined with one another. In at least some examples, the first web 440 and the second web 450 might not have been exposed to electromagnetic radiation by a laser before being combined with one another.

In examples, one or more of the fiber webs 440 and 450 can include any of the properties described in association with FIGS. 1 and 2. In some examples, the fiber webs 440 and 450 can have one or more symmetric properties, as compared to one another. In some examples, the fiber webs 440 and 450 can have one or more asymmetric properties, as compared to one another.

Although two webs 440 and 450 are depicted in FIG. 4, in some examples one or more additional webs can be combined in the composite nonwoven textile 412 with the webs 440 and 450, and the one or more additional webs can include asymmetric properties based on the difference in the amounts of first fibers relative to second fibers. In at least some examples, the composite nonwoven textile 412 can include blends of first fibers and second fibers that change from one portion of the composite nonwoven textile 412 (e.g., closer to the face 420) to another portion of the composite nonwoven textile 412 (e.g., farther from the face 420 and closer to the opposing face).

In some instances, the blend of first fibers to second fibers can increase as the distribution extends from the first face 420 to the opposing face. That is, the amount of first fibers having the ERA material can increase (relative to the second fibers) as the distribution extends from the first face 420 to the opposing face. The increase in the relative amount of first fibers to second fibers can correlate with the blend associated with each fiber web.

In examples, the first fiber web 440 can include a first amount of first fibers 414*a* having a higher propensity to absorb electromagnetic radiation, and the second fiber web 450 can include a second amount of first fibers 414*b* having a higher propensity to absorb electromagnetic radiation, the first and second amounts being different (e.g., the fiber webs 440 and 450 have asymmetric properties based on the difference in the amounts of first fibers relative to second fibers). For example, the first fiber web 440 and the second fiber web 450 can each include various relative amounts (e.g., by weight) of the first fibers 414*a*/414*b* and the second fibers 416*a*/416*b*. In some instances, the relative amounts can include about 30% first fibers 414*a*/414*b* to about 70% second fibers 416*a*/416*b*; or about 25% first fibers 414*a*/414*b* to about 75% second fibers 416*a*/416*b*; or about 20% first fibers 414*a*/414*b* to about 80% second fibers 416*a*/416*b*; or about 15% first fibers 414*a*/414*b* to about 85% second fibers 416*a*/416*b*; or about 10% first fibers 414*a*/414*b* to about 90% second fibers 416*a*/416*b*; or about 5% first fibers 414*a*/414*b* to about 95% second fibers 416*a*/416*b*.

In at least some examples, the asymmetry between the first fiber web 440 and the second fiber web 450 can be quantified based on a relative difference between the amounts of fibers, including a difference between the amounts divided by the average of the amounts. For example, if the first fiber web 440 includes 20% first fibers 414*a* and the second fiber web 450 includes 25% first fibers 414*b*, then the relative difference is 0.18 (e.g., 5% divided by 27.5%). As described, the first fiber web 440 can include, based on weight, less first fibers, as compared to the second fiber web 450.

In at least some examples, the first fiber web 440 and the second fiber web 450 can be exposed to electromagnetic radiation by a laser after being combined with one another. For example, the first fiber web 440 and the second fiber web 450 can be mechanically entangled to form the composite nonwoven textile 412, and the composite nonwoven textile 412 can be exposed to the electromagnetic radiation by projecting a laser onto the first face 420. As indicated above, the first fiber web 440 and the second fiber web 450 can be asymmetric based on having different amounts (e.g., by weight) of the first fibers 414*a*/414*b* relative to the second fibers 416*a*/416*b*. For example, as compared with the second fiber web 450, the first fiber web 440 can have a lower amount of first fibers 414*a* by weight. In examples of the present disclosure, although compared to the second fiber web 450 the first fiber web 440 can have a lower amount of first fibers 414*a*, both fiber webs 440 and 450 can include a density of bonding structures 418*a* and 418*b* (e.g., in a given unit area) conducive to reduced pilling.

In at least some examples, as between the first fiber web 440 and the second fiber web 450, the density of bonding structures 418*a* and 418*b* is relatively more consistent or even, as compared with the asymmetric amounts of the first fibers 414*a*/414*b*. Stated differently, as between the first fiber web 440 and the second fiber web 450, a relative difference of bonding-structure density can be less than the relative difference associated with the amounts of the first fibers. In at least some examples, this relationship in which the density of bonding structures 418*a* and 418*b* is more consistent (even though there are difference in relative amounts of first fibers 414*a*/414*b*) can be based on the electromagnetic radiation being dissipated, reflected, absorbed, or otherwise reduced as it passes from the first face 420 of the composite nonwoven textile 412 and into or through the web of fibers. As such, the first fibers 414*a* that are closer to the first face 420 are more likely (as compared with the first fibers 414*b*) to absorb an amount of the electromagnetic radiation sufficient to soften and/or melt and form bonding structures 418*a*, such that lower amounts of the first fibers 414*a* (as compared with the first fibers 414*b*) are necessary to form a similar number of bonding structures in each of the webs 440 and 450. In at least some examples, the first fibers (e.g., comprising the ERA material) of the fiber webs 440 and 450 can have different amounts of the ERA material. For example, the first fiber web 440 can have first fibers 414*a* having a first amount (e.g., by weight) of the ERA material, and the second fiber web 440 can have first fibers 414*b* having a second amount (e.g., by weight) of the ERA material, the first amount being different from the second amount. Although the per fiber amounts of ERA material can be different, the percentage of first fibers (relative to second fibers) can be substantially the same as between the fiber webs 440 and 450. In other examples, both the per fiber amount of ERA material and the percentage of first fibers (relative to second fibers) can be different. In addition, although two webs 440 and 450 are depicted in FIG. 4, in some examples one or more additional webs can be combined in the composite nonwoven textile 412 with the webs 440 and 450, and the one or more additional webs can include asymmetric properties based on the difference per fiber amount of ERA material. In at least some examples, the composite nonwoven textile 412 can include first fibers having per fiber amounts of ERA material that change from one portion of the composite nonwoven textile 412 (e.g., closer to the face 420) to another portion of the composite nonwoven textile 412 (e.g., farther from the face 420 and closer to the opposing face).

In some instances, the per fiber amount of ERA material can increase as the distribution extends from the first face 420 to the opposing face. That is, the amount of ERA material in the first fibers can increase as the distribution extends from the first face 420 to the opposing face. The increase in the per fiber ERA material can correlate with the change or difference from one fiber web to the next. For instance, In at least some examples in which the per fiber amount of ERA material differs as between the first fibers 414*a* and the first fibers 414*b*, the per fiber amount of ERA material in the first fibers 414*a* can be less than the per fiber amount of ERA in the first fibers 414*b*. In some examples, the per fiber amount of ERA material in the first fibers 414*a* can be at least about 2.5%, and the per fiber amount of ERA material in the first fibers 414*b* can be at least about 5%.

In at least some examples, the bonding structures 418*a* associated with the first fiber web 440 can include first properties that are similar to second properties of the bonding structures 418*b* associated with the second fiber web 450. In at least some examples, the bonding structures 418*a* associated with the first fiber web 440 can include first properties that are asymmetric to second properties of the bonding structures 418*b* associated with the second fiber web 450. For example, the bonding structures 418*a* associated with the first fiber web 440 can include any of the properties described with respect to FIG. 3, and one or more of those properties can be asymmetric to the bonding structures 418*b*.

In at least some examples, asymmetry between properties of the bonding structures 418*a* and 418*b* can be based on the face 420 being oriented towards the laser source when exposed to the electromagnetic radiation. In at least some examples, the asymmetry between properties of the bonding structures 418*a* and 418*b* can be based on the respective blends of first fibers to second fibers in the webs 440 and 450 (and in any other webs that might be combine therewith). In at least some examples, the asymmetry between properties of the bonding structures 418*a* and 418*b* can be based on the respective per fiber amount of ERA material in the webs 440 and 450 (and in any other webs that might be combine therewith).

In some examples, bonding structures that are positioned closer to the face 420 can have a first length, and bonding structures that are positioned closer to the opposing face can have a second length, which is different from the first length. For example, a first average length (e.g., average longest length) of bonding structures in a unit area and/or a unit volume closer to the face 420 can be determined; a second average length (e.g., average longest length) of bonding structures in a unit area and/or a unit volume closer to the opposing face can be determined; and the first and second average lengths can be compared. In some examples, in the composite nonwoven textile 412, the first length is longer than the second length, which can result from various factors. For example, in some instances, the first face 420 can be the side oriented towards or facing the laser when the electromagnetic radiation is applied, and the fibers forming the bonding structures closer to the face 420 can sometimes receive more direct energy and/or higher amounts of energy (as compared to the fibers forming the bonding structures closer to the other face). In some aspects, the fibers 414*a* can include a higher per fiber amount of ERA (as compared with the fibers 414*b*), which can contribute to higher energy absorption. As such, the fibers forming the bonding structures closer to the face 420 can in some cases reach a higher temperature and become more viscous (as compared to the fibers closer to the opposing face and/or associated with the fiber web 450), which can allow the material of the fiber to spread out more when in the more flowable or melted state.

In some examples, the fibers closer to the first face 420 receiving more direct and/or higher amounts of electromagnetic radiation can contribute to asymmetrical shape properties, as compared to the fibers farther from the face 420. For example, as described above, the fibers forming the bonding structures closer to the face 420 can in some cases reach a higher temperature and become more viscous (as compared to the fibers farther from the face). In some cases, this more viscous state can increase the likelihood that the heated fibers might undergo necking, which can include a more central portion becoming elongated and potentially narrower between larger end portions (e.g., forming a dumbbell shape). In contrast, the fibers that are closer to the other face 421 (e.g., exposed to less direct electromagnetic radiation and/or having lower amounts of per fiber ERA material) might be heated to a state that is less viscous than the fibers closer to the face 420, such that the heated fibers expand, but are less likely to neck. As such, the bonding structures farther away from the face 420 (e.g. more associated with the fiber web 450) can be more bulbous in nature, as compared to the bonding structures closer to the face 420.

In some examples, bonding structures that are positioned closer to the face 420 can have a first weight, and bonding structures that are positioned closer to the opposing face 421 can have a second weight, which is different from the first weight. For example, a first average weight (e.g., average weight) of bonding structures in a unit area and/or a unit volume closer to the face 420 can be determined (e.g., bonding structures 418*a* associated with the web 440); a second average weight (e.g., average weight) of bonding structures in a unit area and/or a unit volume closer to the opposing face can be determined (e.g., bonding structures 418*b* associated with the web 450); and the first and second average weight can be compared. In some examples, in the composite nonwoven textile 412, the first weight is larger than the second weight, which can result from various factors. For example, in some instances, the first face 420 can be the side oriented towards or facing the laser when the electromagnetic radiation is applied, and the fibers forming the bonding structures closer to the face 420 can sometimes receive more direct energy and/or higher amounts of energy (as compared to the fibers forming the bonding structures closer to the other face). In some examples, the fibers 414*a* can include a higher per fiber amount of ERA (as compared with the fibers 414*b*), which can contribute to higher energy absorption. In some cases, through direct absorption of the electromagnetic radiation, through conduction, or through other thermal dynamics, larger portions of the first fibers 414*a* can form the bonding structures (as compared to the portions of the first fibers closer to the other face). As such, the bonding structures closer to the face 420 can in some cases include more material from the first fiber (e.g., more material in the amorphous polymer agglomerate), which can contribute to heavier bonding structures.

In some examples, bonding structures 418*a* that are closer to the face 420 can include a first density of bonding structures (e.g., per unit area or per unit volume); bonding structures 418*b* that are closer to the face 421 can include a second density of bonding structures (e.g., per unit area or per unit volume); and the first density can be different from the second density. In some examples, the first density is assessed based on a unit area on the first surface 420, and the second density is assessed based on a unit area on the second surface 421. In at least some examples, the first density is higher than the second density, which can result from various factors. For example, in some instances, the first face 420 can be the side oriented towards or facing the laser when the electromagnetic radiation is applied, and the fibers forming the bonding structures closer to the face 420 can sometimes receive more direct energy and/or higher amounts of energy (as compared to the fibers forming the bonding structures closer to the other face).

In some examples, asymmetric properties among the bonding structures 418*a* and 418*b* can increase usefulness in wearable articles. For example, the first face 420 can be oriented towards an outermost surface of the wearable article and the opposing face 421 can be oriented towards an innermost surface of the wearable article. As such, properties and performance associated with the first face 420 can be different from (asymmetric as compared to) properties and performance associated with the second face 421. The asymmetry between the bonding structures can contribute to the desired properties. For instance, larger bonding structures or a higher density of bonding structures can be more desired for faces, surfaces, or portions of the composite nonwoven textile 412 in which pilling reduction might be more important (e.g., where that part of the web is farther away from a skin surface of a wearer). In addition, smaller bonding structures and/or a lower density of bonding structures can be more desired for faces, surfaces, or portions of the web 340 in which hand-feel might be more important (e.g., where that part of the web is closer to a skin surface of a wearer).

In at least some examples, the composite nonwoven textile 412 can include one or more layers that are between the first web 440 and the second web 450. In at least some examples, the one or more additional layers can have a tendency to impede electromagnetic radiation (e.g., electromagnetic radiation tuned to the ERA material). As such, in some examples, the first web 440 can be treated with electromagnetic radiation with the face 420 oriented towards the laser source, and additionally, the second web 450 can be treated with electromagnetic radiation with the face 421 oriented towards a laser source. For example, the composite nonwoven textile 420 can be flipped, the laser source can be moved, and/or a different lase source can be used. In at least some examples, the first web 440 and the second web 450 can include any of the properties described with respect to FIG. 2, FIG. 3, or FIG. 4, and can be tuned based on whether the respective faces 420 and 421 might be a skin-facing surface or an outer-facing surface facing away from the skin.

CLAUSES

In addition to the claims in this specification, the subject matter in these following clauses could also be claimed.

1. A composite nonwoven textile comprising: a first fiber web comprising first fibers and second fibers, the first fiber web comprising a machine direction, a cross-machine direction, and a thickness, wherein: the first fibers, as compared to the second fibers, comprise a higher amount of an ERA material; the first fiber web comprises at least 10% by weight of the first fibers; the first fibers and the second fibers are homogeneously distributed in one or more of the machine, cross-machine direction, and the thickness of the first fiber web; and the first fiber web comprises a plurality of amorphous polymer agglomerates that include material from one or more fibers of the first fibers at least partially encapsulating one or more fibers of the second fibers.

2. The composite nonwoven textile of clause 1, wherein the first fibers comprise an amount of the ERA material equal to, or less than, about 5% by weight of the first fibers.
3. The composite nonwoven textile of clause 2, wherein the amount of the ERA material is equal to, or less than, about 2.5% by weight of the first fibers.
4. The composite nonwoven textile of any of the preceding clauses 1 through 3, wherein the ERA material comprises a pigment having a color property.
5. The composite nonwoven textile of any of the preceding clauses 1 through 4, wherein the first fibers comprise multi-component fibers that include a first component comprising the ERA material and a second component comprising a second material, the second material comprising a lower propensity to absorb electromagnetic radiation emitted by the laser compared to said first material.
6. The composite nonwoven textile of clause 5, wherein the multi-component fiber comprises a core and a sheath, the first component comprising one of the core or the sheath, and the second component comprising the other of the core or the sheath.
7. The composite nonwoven textile of clause 5 or clause 6, wherein the ERA material comprises a lower melt temperature than the second material.
8. The composite nonwoven textile of clause 5 or clause 6, wherein the ERA material comprises a higher melt temperature than the second material.
9. The composite nonwoven textile of clause 5 or clause 6, wherein the ERA material and the second material comprise substantially equal melt temperatures.
10. The composite nonwoven textile of any of the preceding clauses 1 through 9, wherein the first fibers are oriented at a first angle that is relative to the machine direction and that is in a range of about 30 degrees to about 60 degrees.
11. The composite nonwoven textile of clause 10, wherein the first angle is about 45 degrees.
12. The composite nonwoven textile of any of the preceding clauses 1 through 11 further comprising, a second fiber web that comprises third fibers and fourth fibers, wherein: the third fibers, as compared to the fourth fibers, comprise a higher amount of the ERA material; the second fiber web comprises at least about 10% by weight of the third fibers; and the second fiber web comprises a plurality of amorphous polymer agglomerates that include material from one or more fibers of the third fibers encapsulating one or more fibers of the fourth fibers.
13. The composite nonwoven textile of clause 12, wherein a percentage of the first fiber web comprised of the first fibers is less than a percentage of the second fiber web comprised of the third fibers.
14. The composite nonwoven textile of clause 13, wherein: the percentage of the first fiber web comprised of the first fibers is between about 10% to about 25%; and the percentage of the second fiber web comprised of the third fibers is between about 15% and 30%.
15. The composite nonwoven textile of clause 12, wherein a percentage of the first fiber web comprised of the first fibers is substantially equal to a percentage of the second fiber web comprised of the third fibers.
16. The composite nonwoven textile of any of the preceding clauses 1 through 15, wherein the percentage of the first fiber web comprised of the first fibers is between about 10% and about 30%.
17. The composite nonwoven textile of clause 16, wherein the percentage of the first fiber web comprised of the first fibers is between about 15% and about 25%.
18. The composite nonwoven textile of any of the preceding clauses 12 through 17, wherein at least some fibers of the first fiber web are entangled with fibers of the second fiber web.
19. The composite nonwoven textile of any of the preceding clauses 12 through 18 further comprising, an elastic layer arranged between the first fiber web and the second fiber web, the elastic layer comprising a thermoplastic polymer.
20. The composite nonwoven textile of clause 19, wherein the elastic layer comprises a nonwoven textile layer.
21. The composite nonwoven textile of clause 20, wherein the nonwoven textile layer comprises a spun-bond layer, a melt-blown layer, or a scrim.
22. The composite nonwoven textile of any of clauses 19 through 21, wherein the thermoplastic polymer comprises a thermoplastic elastomer.
23. The composite nonwoven textile of clause 22, wherein the thermoplastic elastomer comprises thermoplastic polyurethane (TPU) or thermoplastic polyether ester elastomer (TPEE).
24. The composite nonwoven textile of any of clauses 1 to 24, wherein the composite nonwoven textile comprises at least a portion of a wearable article.
25. The composite nonwoven textile of clause 24, wherein the wearable article comprises an upper-body garment, a lower-body garment, or a footwear article.
26. The composite nonwoven textile of clause 25, wherein the composite nonwoven textile comprises at least a portion of an upper of the footwear article.
27. The composite nonwoven textile of any of clauses 24 to 26, wherein the first fiber web comprises an outermost surface of the wearable article.
28. The composite nonwoven textile of clause 27, wherein the second fiber web comprises an innermost surface of the wearable article.
29. A composite nonwoven textile comprising: a fiber web comprising a machine direction, a cross direction, a thickness, first fibers and second fibers, wherein: the first fibers, as compared to the second fibers, comprise a higher amount of an ERA material; at least some the first fibers are generally oriented at a first angle relative to the machine direction of the first fiber web and in a range of about 30 degrees to about 60 degrees; and the first fiber web comprises a plurality of amorphous polymer agglomerates that include material from one or more fibers of the first fibers encapsulating one or more fibers of the second fibers.
30. The composite nonwoven textile of clause 29, wherein the first fibers comprise an amount of the ERA material equal to, or less than, about 5% by weight of the first fibers.
31. The composite nonwoven textile of clause 30, wherein the amount of the ERA material is equal to, or less than, about 2.5% by weight of the first fibers.
32. The composite nonwoven textile of any of clauses 29 through 31, wherein the ERA material comprises a pigment having a color property.
33. The composite nonwoven textile of any of the preceding clauses 29 through 32, wherein the first fibers comprise multi-component fibers that include a first component comprising the ERA material and a second component comprising a second material, the second material comprising a lower propensity to absorb electromagnetic radiation emitted by the laser compared to said first material.

34. The composite nonwoven textile of clause 33, wherein the multi-component fiber comprises a core and a sheath, the first component comprising one of the core or the sheath, and the second component comprising the other of the core or the sheath.

35. The composite nonwoven textile of clause 33 or clause 34, wherein the ERA material comprises a lower melt temperature than the second material.

36. The composite nonwoven textile of clause 33 or clause 34, wherein the ERA material comprises a higher melt temperature than the second material.

37. The composite nonwoven textile of clause 33 or clause 34, wherein the ERA material and the second material comprise substantially equal melt temperatures.

38. The composite nonwoven textile of any of clauses 29 through 37, wherein the fiber web comprises at least 10% by weight of the first fibers.

39. The composite nonwoven textile of clause 38, wherein the fiber web comprises at least 15% by weight of the first fibers.

40. The composite nonwoven textile of clause 39, wherein the fiber web comprises at least 20% by weight of the first fibers.

41. The composite nonwoven textile of clause 40, wherein the fiber web comprises at least 25% by weight of the first fibers.

42. The composite nonwoven textile of any of clauses 29 through 37, wherein the fiber web comprises about 10% to about 30% by weight of the first fibers.

43. The composite nonwoven textile of any of the preceding clauses 29 through 42 further comprising, a second fiber web comprising a machine direction, a cross direction, a thickness, third fibers, and fourth fibers, wherein: the third fibers, as compared to the fourth fibers, comprise a higher amount of the ERA material; at least some of the third fibers are generally oriented at a second angle relative to the machine direction and in a range of about 30 degrees to about 60 degrees; and the second fiber web comprises a plurality of amorphous polymer agglomerates that include material from one or more fibers of the third fibers encapsulating one or more fibers of the fourth fibers.

44. The composite nonwoven textile of clause 43, wherein at least some fibers of the first fiber web are entangled with fibers of the second fiber web.

45. The composite nonwoven textile of clause 43 or 44 further comprising, an elastic layer arranged between the first fiber web and the second fiber web, the elastic layer comprising a thermoplastic polymer.

46. The composite nonwoven textile of clause 45, wherein the elastic layer comprises a nonwoven textile layer.

47. The composite nonwoven textile of clause 46, wherein the nonwoven textile layer comprises a spun-bond layer, a melt-blown layer, or a scrim.

48. The composite nonwoven textile of any of clauses 45 through 47, wherein the thermoplastic polymer comprises a thermoplastic elastomer.

49. The composite nonwoven textile of clause 48, wherein the thermoplastic elastomer comprises thermoplastic polyurethane (TPU) or thermoplastic polyether ester elastomer (TPEE).

50. The composite nonwoven textile of any of clauses 29 through 49, wherein the composite nonwoven textile comprises at least a portion of a wearable article.

51. The composite nonwoven textile of clause 50, wherein the wearable article comprises an upper-body garment, a lower-body garment, or a footwear article.

52. The composite nonwoven textile of clause 51, wherein the composite nonwoven textile comprises at least a portion of an upper of the footwear article.

53. The composite nonwoven textile of any of clauses 50 to 52, wherein the first fiber web comprises an outermost surface of the wearable article.

54. The composite nonwoven textile of clause 53, wherein the second fiber web comprises an innermost surface of the wearable article.

55. A composite nonwoven textile comprising: a first fiber web comprising first fibers and second fibers, the first fiber web comprising a machine direction, a cross-machine direction, and a thickness, wherein: the first fibers, as compared to the second fibers, comprise a higher amount of an ERA material; the first fiber web comprises a homogenous blend of first fibers to second fibers distributed in one or more of the machine direction, the cross-machine direction, and the thickness; and the first fiber web comprises a plurality of amorphous polymer agglomerates that include material from one or more fibers of the first fibers encapsulating one or more fibers of the second fibers.

56. The composite nonwoven textile of clause 55, wherein the substantially homogenous blend is distributed in the machine direction and in the cross-machine direction.

57. The composite nonwoven textile of clause 55 or 56, wherein the substantially homogenous blend is distributed continuously through the thickness from a first face of the first fiber web to a second opposing face of the fiber web.

58. The composite nonwoven textile of clause 55 or 56, wherein: the homogenous blend is in a first portion of the first fiber web; and the first fiber web comprises a second portion comprising a nonhomogeneous blend extending continuously through the thickness from the first face of the fiber web to an opposing second face.

59. The composite nonwoven textile of any of clauses 55 through 58, wherein the first fibers comprise an amount of the ERA material equal to, or less than, about 5% by weight of the first fibers.

60. The composite nonwoven textile of clause 59, wherein the amount of the ERA material is equal to, or less than, about 2.5% by weight of the first fibers.

61. The composite nonwoven textile of any of clauses 55 through 60, wherein the ERA material comprises a pigment having a color property.

62. The composite nonwoven textile of any of the preceding clauses 55 through 61, wherein the first fibers comprise multi-component fibers that include a first component comprising the ERA material and a second component comprising a second material, the second material comprising a lower propensity to absorb electromagnetic radiation emitted by the laser compared to said first material.

63. The composite nonwoven textile of clause 62, wherein the multi-component fiber comprises a core and a sheath, the first component comprising one of the core or the sheath, and the second component comprising the other of the core or the sheath.

64. The composite nonwoven textile of clause 62 or clause 63, wherein the ERA material comprises a lower melt temperature than the second material.
65. The composite nonwoven textile of clause 62 or clause 63 wherein the ERA material comprises a higher melt temperature than the second material.
66. The composite nonwoven textile of clause 62 or clause 63, wherein the ERA material and the second material comprise substantially equal melt temperatures.
67. The composite nonwoven textile of any of clauses 55 through 66, wherein the fiber web comprises at least 10% by weight of the first fibers.
68. The composite nonwoven textile of clause 67, wherein the fiber web comprises at least 15% by weight of the first fibers.
69. The composite nonwoven textile of clause 68, wherein the fiber web comprises at least 20% by weight of the first fibers.
70. The composite nonwoven textile of clause 69, wherein the fiber web comprises at least 25% by weight of the first fibers.
71. The composite nonwoven textile of any of clauses 55 through 66, wherein the fiber web comprises about 10% to about 30% by weight of the first fibers.
72. The composite nonwoven textile of any of the preceding clauses 55 through 71 further comprising, a second fiber web comprising a machine direction, a cross direction, a thickness, third fibers, and fourth fibers, wherein: the third fibers, as compared to the fourth fibers, comprise a higher amount of the ERA material; the second fiber web comprises a substantially homogenous blend of third fibers to fourth fibers distributed in one or more of the machine direction, the cross-machine direction, and the thickness of the second fiber web; and the second fiber web comprises a plurality of amorphous polymer agglomerates that include material from one or more fibers of the third fibers encapsulating one or more fibers of the fourth fibers.
73. The composite nonwoven textile of clause 74, wherein at least some fibers of the first fiber web are entangled with fibers of the second fiber web.
74. The composite nonwoven textile of clause 72 or 73 further comprising, an elastic layer arranged between the first fiber web and the second fiber web, the elastic layer comprising a thermoplastic polymer.
75. The composite nonwoven textile of clause 74, wherein the elastic layer comprises a nonwoven textile layer.
76. The composite nonwoven textile of clause 75, wherein the nonwoven textile layer comprises a spun-bond layer, a melt-blown layer, or a scrim.
77. The composite nonwoven textile of any of clauses 74 through 76, wherein the thermoplastic polymer comprises a thermoplastic elastomer.
78. The composite nonwoven textile of clause 77, wherein the thermoplastic elastomer comprises thermoplastic polyurethane (TPU) or thermoplastic polyether ester elastomer (TPEE).
79. The composite nonwoven textile of any of clauses 55 through 78, wherein the composite nonwoven textile comprises at least a portion of a wearable article.
80. The composite nonwoven textile of clause 79, wherein the wearable article comprises an upper-body garment, a lower-body garment, or a footwear article.
81. The composite nonwoven textile of clause 80, wherein the composite nonwoven textile comprises at least a portion of an upper of the footwear article.
82. The composite nonwoven textile of any of clauses 79 to 81, wherein the first fiber web comprises an outermost surface of the wearable article.
83. The composite nonwoven textile of clause 82, wherein the second fiber web comprises an innermost surface of the wearable article.
84. A composite nonwoven textile comprising: a first fiber web comprising first fibers and second fibers, wherein: the first fibers, as compared to the second fibers, comprise a higher amount of an ERA material; the first fiber web comprises, within a first unit volume, a first relative amount by weight of first fibers to second fibers; and the first fiber web comprises, within the first unit volume, a first quantity of amorphous polymer agglomerates that include material from one or more fibers of the first fibers encapsulating one or more fibers of the second fibers; and a second fiber web that comprises third fibers and fourth fibers, wherein: the third fibers, as compared to the fourth fibers, comprise a higher amount of the ERA material; the second fiber web comprises, within a second unit volume, a second relative amount by weight of third fibers to fourth fibers, which is larger than the first relative amount; and the second fiber web comprises, within second unit volume, a second quantity of amorphous polymer agglomerates that include material from one or more fibers of the third fibers encapsulating one or more fibers of the fourth fibers, wherein a first relative difference between the first quantity and the second quantity is less than a second relative difference between the first relative amount and the second relative amount.
85. The composite nonwoven textile of clause 86, wherein the first fibers comprise an amount of the ERA material equal to, or less than, about 5% by weight of the first fibers.
86. The composite nonwoven textile of clause 85, wherein the amount of the ERA material is equal to, or less than, about 2.5% by weight of the first fibers.
87. The composite nonwoven textile of any of the preceding clauses 84 through 86, wherein the ERA material comprises a pigment having a color property.
88. The composite nonwoven textile of any of the preceding clauses 84 through 87, wherein the first fibers comprise multi-component fibers that include a first component comprising the ERA material and a second component comprising a second material, the second material comprising a lower propensity to absorb electromagnetic radiation emitted by the laser compared to said first material.
89. The composite nonwoven textile of clause 88, wherein the multi-component fiber comprises a core and a sheath, the first component comprising one of the core or the sheath, and the second component comprising the other of the core or the sheath.
90. The composite nonwoven textile of clause 88 or clause 89, wherein the ERA material comprises a lower melt temperature than the second material.
91. The composite nonwoven textile of clause 88 or clause 89, wherein the ERA material comprises a higher melt temperature than the second material.

92. The composite nonwoven textile of clause 88 or clause 89, wherein the ERA material and the second material comprise substantially equal melt temperatures.

93. The composite nonwoven textile of any of the preceding clauses 84 through 92, wherein the first fibers are oriented at a first angle that is relative to the machine direction and that is in a range of about 30 degrees to about 60 degrees.

94. The composite nonwoven textile of clause 95, wherein the first angle is about 45 degrees.

95. The composite nonwoven textile of any of the preceding clauses 84 through 94, wherein the percentage of the first fiber web comprised of the first fibers is between about 10% and about 30%.

96. The composite nonwoven textile of clause 95, wherein the percentage of the first fiber web comprised of the first fibers is between about 15% and about 25%.

97. The composite nonwoven textile of any of the preceding clauses 84 through 96, wherein at least some fibers of the first fiber web are entangled with fibers of the second fiber web.

98. The composite nonwoven textile of any of the preceding clauses 84 through 97 further comprising, an elastic layer arranged between the first fiber web and the second fiber web, the elastic layer comprising a thermoplastic polymer.

99. The composite nonwoven textile of clause 98, wherein the elastic layer comprises a nonwoven textile layer.

100. The composite nonwoven textile of clause 99, wherein the nonwoven textile layer comprises a spunbond layer, a melt-blown layer, or a scrim.

101. The composite nonwoven textile of any of clauses 98 through 100, wherein the thermoplastic polymer comprises a thermoplastic elastomer.

102. The composite nonwoven textile of clause 101, wherein the thermoplastic elastomer comprises thermoplastic polyurethane (TPU) or thermoplastic polyether ester elastomer (TPEE).

103. The composite nonwoven textile of any of clauses 84 through 102 wherein the composite nonwoven textile comprises at least a portion of a wearable article.

104. The composite nonwoven textile of clause 103, wherein the wearable article comprises an upper-body garment, a lower-body garment, or a footwear article.

105. The composite nonwoven textile of clause 104, wherein the composite nonwoven textile comprises at least a portion of an upper of the footwear article.

106. The composite nonwoven textile of any of clauses 103 to 105, wherein the first fiber web comprises an outermost surface of the wearable article.

107. The composite nonwoven textile of clause 106, wherein the second fiber web comprises an innermost surface of the wearable article.

108. The composite nonwoven textile of any of clauses 84 to 107, wherein first fiber web further comprises one or more amorphous polymer agglomerates comprising material from one or more fibers of the third fibers encapsulating one or more fibers of the second fibers, one or more fibers of the fourth fibers, or any combination thereof.

109. The composite nonwoven textile of any of clauses 84 to 108, wherein the second fiber web further comprises one or more amorphous polymer agglomerates comprising material from one or more fibers of the first fibers encapsulating one or more fibers of the second fibers, one or more fibers of the fourth fibers, or any combination thereof.

110. The composite nonwoven textile of any of clauses 1 to 28, wherein the first fibers and the second fibers are substantially homogenously distributed in one or more of the machine direction and in the cross direction.

111. The composite nonwoven textile of any of clauses 1 to 28 and 110, wherein the first fibers and the second fibers comprise a gradient distribution that gradually increases through the thickness by relative amount of the first fibers.

112. The composite nonwoven textile of any of clauses 29 to 54, wherein at least some of the second fibers are generally oriented at a second angle relative to the machine direction of the first fiber web and in a range of about 30 degrees to about 60 degrees.

113. The composite nonwoven textile of clause 112, wherein the second angle is about 45 degrees.

114. The composite nonwoven textile of any of clauses 29 to 54, wherein at least some of the second fibers are generally oriented at a second angle relative to the at least some of the first fibers, and wherein the second angle is in a range of about 30 degrees to about 60 degrees.

113. The composite nonwoven textile of clause 114, wherein the second angle is about 45 degrees.

114. A composite nonwoven textile comprising: a machine direction, a cross-machine direction, and a thickness; first fibers and second fibers, wherein the first fibers, as compared to the second fibers, comprise a higher amount of an ERA material; and a homogenous distribution of amorphous polymer agglomerates in one or more of the machine direction, the cross-machine direction, and the thickness, wherein the amorphous polymer agglomerates comprise material from one or more fibers of the first fibers encapsulating one or more fibers of the second fibers.

115. The composite nonwoven textile of clause 114, wherein the substantially homogenous distribution is in the machine direction and in the cross-machine direction.

116. The composite nonwoven textile of clause 114 or 115, wherein the substantially homogenous distribution is continuous through the thickness from a first face of the composite nonwoven textile to an opposing second face of the composite nonwoven textile.

117. The composite nonwoven textile of clause 116, wherein: the substantially homogenous distribution is in a first portion of the composite nonwoven textile; and the composite nonwoven textile comprises a second portion comprising a nonhomogeneous distribution extending continuously through the thickness from the first face to the opposing second face.

118. The composite nonwoven textile of any of clauses 114 through 117, wherein the first fibers comprise an amount of the ERA material equal to, or less than, about 5% by weight of the first fibers.

119. The composite nonwoven textile of clause 118, wherein the amount of the ERA material is equal to, or less than, about 2.5% by weight of the first fibers.

120. The composite nonwoven textile of any of clauses 114 through 119, wherein the ERA material comprises a pigment having a color property.

121. The composite nonwoven textile of any of the preceding clauses 114 through 120, wherein the first fibers comprise multi-component fibers that include a first component comprising the ERA material and a second component comprising a second material, the second material comprising a lower propensity to absorb electromagnetic radiation emitted by the laser compared to said first material.

122. The composite nonwoven textile of clause 121, wherein the multi-component fiber comprises a core and a sheath, the first component comprising one of the core or the sheath, and the second component comprising the other of the core or the sheath.

123. The composite nonwoven textile of clause 121 or clause 122, wherein the ERA material comprises a lower melt temperature than the second material.

124. The composite nonwoven textile of clause 121 or clause 122, wherein the ERA material comprises a higher melt temperature than the second material.

125. The composite nonwoven textile of clause 121 or clause 122, wherein the ERA material and the second material comprise substantially equal melt temperatures.

126. The composite nonwoven textile of any of clauses 114 through 126, wherein the composite nonwoven textile comprises at least 10% by weight of the first fibers.

127. The composite nonwoven textile of clause 126, wherein the composite nonwoven textile comprises at least 15% by weight of the first fibers.

128. The composite nonwoven textile of clause 127, wherein the composite nonwoven textile comprises at least 20% by weight of the first fibers.

129. The composite nonwoven textile of clause 128, wherein the composite nonwoven textile comprises at least 25% by weight of the first fibers.

130. The composite nonwoven textile of any of clauses 114 through 125, wherein the composite nonwoven textile comprises about 10% to about 30% by weight of the first fibers.

131. The composite nonwoven textile of any of the preceding clauses 114 through 130, wherein the composite nonwoven textile comprises a first fiber web entangled with a second fiber web.

132. The composite nonwoven textile of clause 131, wherein:

the first fiber web comprises a first substantially homogenous blend of the first fibers to second fibers; and the second fiber web comprises a second substantially homogenous blend of first fibers to second fibers.

133. The composite nonwoven textile of clause 132, wherein the first substantially homogenous blend is different from the second substantially homogenous blend, and wherein the second substantially homogenous blend comprises a higher percentage of first fibers.

134. The composite nonwoven textile of any of clauses 131 to 133 further comprising, an elastic layer arranged between the first fiber web and the second fiber web, the elastic layer comprising a thermoplastic polymer.

135. The composite nonwoven textile of clause 134, wherein the elastic layer comprises a nonwoven textile layer.

136. The composite nonwoven textile of clause 135, wherein the nonwoven textile layer comprises a spunbond layer, a melt-blown layer, or a scrim.

137. The composite nonwoven textile of any of clauses 134 through 136, wherein the thermoplastic polymer comprises a thermoplastic elastomer.

138. The composite nonwoven textile of clause 137, wherein the thermoplastic elastomer comprises thermoplastic polyurethane (TPU) or thermoplastic polyether ester elastomer (TPEE).

139. The composite nonwoven textile of any of clauses 114 through 138, wherein the composite nonwoven textile comprises at least a portion of a wearable article.

140. The composite nonwoven textile of clause 139, wherein the wearable article comprises an upper-body garment, a lower-body garment, or a footwear article.

141. The composite nonwoven textile of clause 140, wherein the composite nonwoven textile comprises at least a portion of an upper of the footwear article.

142. The composite nonwoven textile of any of clauses 139 to 141, wherein the first fiber web comprises an outermost surface of the wearable article.

143. The composite nonwoven textile of clause 142, wherein the second fiber web comprises an innermost surface of the wearable article.

145. A method of making a composite nonwoven textile comprising: blending first fibers and second fibers into a first fiber mix, the first fibers, as compared to the second fibers, comprising a higher amount of an ERA material; constructing, by carding the first fiber mix, a carded fiber web; constructing, by cross-lapping the carded fiber web, a cross-lapped fiber web; constructing, by mechanically entangling the cross-lapped fiber web, the composite nonwoven textile; and applying electromagnetic radiation from a laser source to the first fibers and the second fibers.

146. The method of clause 145, wherein applying the electromagnetic radiation provides a plurality of amorphous polymer agglomerates that include material from one or more fibers of the first fibers encapsulating one or more fibers of the second fibers 147. The method of clause 145 or clause 146, wherein the electromagnetic radiation is applied to the composite nonwoven textile.

148. The method of clause 145 or clause 146, wherein the electromagnetic radiation is applied to the first fibers and the second fibers before mechanically entangling the cross-lapped fiber web.

149. The method of clause 148, wherein the electromagnetic radiation is applied to the first fibers and the second fibers before cross-lapping the carded fiber web.

150. The method of any of clauses 145 to 149, wherein blending first fibers and second fibers into the first fiber mix comprises blending at least about 10% by weight of the first fibers.

151. The method of clause 150, wherein blending first fibers and second fibers into the first fiber mix comprises blending at least about 15% by weight of the first fibers.

152. The method of clause 151, wherein blending first fibers and second fibers into the first fiber mix comprises blending at least about 20% by weight of the first fibers.

153. The method of clause 152, wherein blending first fibers and second fibers into the first fiber mix comprises blending at least about 25% by weight of the first fibers.

154. The method of any of clauses 144 to 149, wherein blending first fibers and second fibers into the first fiber mix comprises blending a range of about 10% to about 30% by weight of the first fibers.

155. The method of any of preceding clauses 144 to 154, the first fibers comprise an amount of the ERA material equal to, or less than, about 5% by weight of the first fibers.

156. The method of clause 155, wherein the amount of the ERA material is equal to, or less than, about 2.5% by weight of the first fibers.

157. The method of any of the preceding clauses 144 to 156, wherein:

mechanically entangling comprises mechanically entangling the cross-lapped fiber web with a second cross-lapped fiber web; and the second cross-lapped fiber web comprises a second fiber mix of third fibers and fourth fibers, the third fibers, as compared to the fourth fibers, comprising a higher amount of the ERA material.

158. A composite nonwoven textile comprising: a first fiber web comprising first fibers and second fibers, wherein: the first fibers, as compared to the second fibers, comprise a higher amount of an ERA material; and the first fiber web comprises a plurality of amorphous polymer agglomerates that include material from one or more fibers of the first fibers encapsulating one or more fibers of the second fibers; and a second fiber web that comprises third fibers and fourth fibers, wherein: the third fibers, as compared to the fourth fibers, comprise a higher amount of the ERA material; the second fiber web comprises a plurality of amorphous polymer agglomerates that include material from one or more fibers of the third fibers encapsulating one or more fibers of the fourth fibers; and the second fiber web comprises, as compared to the first fiber web, a higher amount by weight of the ERA material.

159. The composite nonwoven textile of clause 158, wherein the first fibers comprise an amount of the ERA material equal to, or less than, about 5% by weight of the first fibers.

160. The composite nonwoven textile of clause 159, wherein the amount of the ERA material in the first fibers is equal to, or less than, about 2.5% by weight of the first fibers.

161. The composite nonwoven textile of any of the preceding clauses 158 through 160, wherein the third fibers compositionally comprise a higher amount of the ERA material as compared to the first fibers.

162. The composite nonwoven textile of any of clauses 158 to 161, wherein a percentage by weight of the first fiber web comprised of the first fibers is less than a percentage by weight of the second fiber web comprised of the third fibers.

163. The composite nonwoven textile of clause 162, wherein:

the percentage of the first fiber web comprised of the first fibers is between about 10% to about 25%; and the percentage of the second fiber web comprised of the third fibers is between about 15% and 30%.

164. The composite nonwoven textile of any of clauses 158 to 161, wherein a percentage of the first fiber web comprised of the first fibers is substantially equal to a percentage of the second fiber web comprised of the third fibers.

165. The composite nonwoven textile of any of the preceding clauses 158 to 164, wherein at least some fibers of the first fiber web are entangled with fibers of the second fiber web.

166. The composite nonwoven textile of any of the preceding clauses 158 through 165 further comprising, an elastic layer arranged between the first fiber web and the second fiber web, the elastic layer comprising a thermoplastic polymer.

167. The composite nonwoven textile of clause 166, wherein the elastic layer comprises a nonwoven textile layer.

168. The composite nonwoven textile of clause 167, wherein the nonwoven textile layer comprises a spunbond layer, a melt-blown layer, or a scrim.

169. The composite nonwoven textile of any of clauses 166 through 168, wherein the thermoplastic polymer comprises a thermoplastic elastomer.

170. The composite nonwoven textile of clause 169, wherein the thermoplastic elastomer comprises thermoplastic polyurethane (TPU) or thermoplastic polyether ester elastomer (TPEE).

171. The composite nonwoven textile of any of clauses 158 to 170, wherein the composite nonwoven textile comprises at least a portion of a wearable article.

172. The composite nonwoven textile of clause 171, wherein the wearable article comprises an upper-body garment, a lower-body garment, or a footwear article.

173. The composite nonwoven textile of clause 172, wherein the composite nonwoven textile comprises at least a portion of an upper of the footwear article.

174. The composite nonwoven textile of any of clauses 171 to 173, wherein the first fiber web comprises an outermost surface of the wearable article.

175. The composite nonwoven textile of clause 174, wherein the second fiber web comprises an innermost surface of the wearable article.

176. The composite nonwoven textile of clause 161, wherein at least some third fibers are not entangled with the first fibers or the second fibers and at least some first fibers are not entangled with the third fibers or the fourth fibers.

177. A composite nonwoven textile comprising: a first face, an opposing second face, a machine direction, a cross-machine direction, and a thickness extending between the first face and the second face; first fibers and second fibers, wherein the first fibers, as compared to the second fibers, comprise a higher amount of an ERA material; and a first set of amorphous polymer agglomerates comprising a first property and a second set of amorphous polymer agglomerates comprising a second property, wherein: the amorphous polymer agglomerates of the first set and the second set comprise material from one or more fibers of the first fibers encapsulating one or more fibers of the second fibers; and the first property is asymmetrical to the second property.

178. The composite nonwoven textile of clause 177, wherein the first property and the second property comprise an average size of the amorphous polymer agglomerates in each set based on weight.

179. The composite nonwoven textile of clause 177, wherein the first property and the second property comprise an average longest length the amorphous polymer agglomerates in each set.

180. The composite nonwoven textile of clause 177, wherein the first property and the second property comprise an average largest diameter of the amorphous polymer agglomerates in each set.

181. The composite nonwoven textile of clause 177, wherein the first property and the second property comprise an amount of necking of the amorphous polymer agglomerates in each set.

182. The composite nonwoven textile of any of clauses 177 to 181, wherein the first fibers comprise an amount of the ERA material equal to, or less than, about 5% by weight of the first fibers.

183. The composite nonwoven textile of clause 182, wherein the amount of the ERA material is equal to, or less than, about 2.5% by weight of the first fibers.

184. The composite nonwoven textile of any of clauses 177 through 183, wherein the ERA material comprises a pigment having a color property.

185. The composite nonwoven textile of any of the preceding clauses 177 through 184, wherein the first fibers comprise multi-component fibers that include a first component comprising the ERA material and a second component comprising a second material, the second material comprising a lower propensity to absorb electromagnetic radiation emitted by the laser compared to said first material.

186. The composite nonwoven textile of clause 185, wherein the multi-component fiber comprises a core and a sheath, the first component comprising one of the core or the sheath, and the second component comprising the other of the core or the sheath.

187. The composite nonwoven textile of clause 185 or clause 186, wherein the ERA material comprises a lower melt temperature than the second material.

188. The composite nonwoven textile of clause 185 or clause 186, wherein the ERA material comprises a higher melt temperature than the second material.

189. The composite nonwoven textile of clause 185 or clause 186, wherein the ERA material and the second material comprise substantially equal melt temperatures.

190. The composite nonwoven textile of any of clauses 177 through 189, wherein the composite nonwoven textile comprises at least 10% by weight of the first fibers.

191. The composite nonwoven textile of clause 190, wherein the composite nonwoven textile comprises at least 15% by weight of the first fibers.

192. The composite nonwoven textile of clause 191, wherein the composite nonwoven textile comprises at least 20% by weight of the first fibers.

193. The composite nonwoven textile of clause 192, wherein the composite nonwoven textile comprises at least 25% by weight of the first fibers.

194. The composite nonwoven textile of any of clauses 177 through 189, wherein the composite nonwoven textile comprises about 10% to about 30% by weight of the first fibers.

195. The composite nonwoven textile of any of the preceding clauses 177 through 194, wherein the composite nonwoven textile comprises a first fiber web entangled with a second fiber web.

196. The composite nonwoven textile of clause 195, wherein: the first fiber web comprises a first substantially homogenous blend of the first fibers to second fibers; and the second fiber web comprises a second substantially homogenous blend of first fibers to second fibers.

197. The composite nonwoven textile of clause 196, wherein the first substantially homogenous blend is different from the second substantially homogenous blend, and wherein the second substantially homogenous blend comprises a higher percentage of first fibers.

198. The composite nonwoven textile of any of clauses 195 to 197 further comprising, an elastic layer arranged between the first fiber web and the second fiber web, the elastic layer comprising a thermoplastic polymer.

199. The composite nonwoven textile of clause 198, wherein the elastic layer comprises a nonwoven textile layer.

200. The composite nonwoven textile of clause 199, wherein the nonwoven textile layer comprises a spunbond layer, a melt-blown layer, or a scrim.

201. The composite nonwoven textile of any of clauses 198 through 200, wherein the thermoplastic polymer comprises a thermoplastic elastomer.

202. The composite nonwoven textile of clause 201, wherein the thermoplastic elastomer comprises thermoplastic polyurethane (TPU) or thermoplastic polyether ester elastomer (TPEE).

203. The composite nonwoven textile of any of clauses 177 through 202, wherein the composite nonwoven textile comprises at least a portion of a wearable article.

204. The composite nonwoven textile of clause 203, wherein the wearable article comprises an upper-body garment, a lower-body garment, or a footwear article.

205. The composite nonwoven textile of clause 204, wherein the composite nonwoven textile comprises at least a portion of an upper of the footwear article.

206. The composite nonwoven textile of any of clauses 203 to 205, wherein the first fiber web comprises an outermost surface of the wearable article.

207. The composite nonwoven textile of clause 206, wherein the second fiber web comprises an innermost surface of the wearable article.

208. The composite nonwoven textile of clause 1, wherein the first fibers and the second fibers are associated with a blend of first fibers to second fibers that is highly homogenous.

209. The composite nonwoven textile of clause 55, wherein the first fiber web comprises a highly homogenous blend of first fibers to second fibers.

210. The composite nonwoven textile of clause 114, wherein the homogenous distribution of amorphous polymer agglomerates is based on a density across regions of interest.

211. The composite nonwoven textile of clause 210, wherein the homogenous distribution is highly homogenous.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A composite nonwoven textile comprising:

a first fiber web comprising first fibers and second fibers, the first fiber web comprising a machine direction, a cross-machine direction, and a thickness, wherein:

the first fibers, as compared to the second fibers, comprise a higher amount of an ERA material;

the first fiber web comprises a substantially homogenous blend of first fibers to second fibers distributed in one or more of the machine direction, the cross-machine direction, and the thickness; and the first fiber web comprises a plurality of amorphous polymer agglomerates that include material from one or more fibers of the first fibers encapsulating one or more fibers of the second fibers; and the substantially homogenous blend is distributed in the machine direction and in the cross-machine direction.

2. The composite nonwoven textile of claim 1, wherein the substantially homogenous blend is distributed continuously through the thickness from a first face of the first fiber web to a second opposing face of the fiber web.

3. The composite nonwoven textile of claim 1, wherein the first fibers comprise an amount of the ERA material equal to, or less than, about 5% by weight of the first fibers.

4. The composite nonwoven textile of claim 1, wherein the amount of the ERA material is equal to, or less than, about 2.5% by weight of the first fibers.

5. The composite nonwoven textile of claim 1, wherein the first fibers comprise a core and a sheath; wherein one of the core or the sheath comprises the ERA material and the other of the core or the sheath comprises a second material, which comprises, as compared to the ERA material, a lower propensity to absorb electromagnetic radiation.

6. The composite nonwoven textile of claim 5, wherein the ERA material comprises a lower melt temperature than the second material.

7. The composite nonwoven textile of claim 5, wherein the ERA material comprises a higher melt temperature than the second material.

8. The composite nonwoven textile of claim 1, wherein the first fibers comprise about 10% to about 30% by weight of the first fiber web.

9. The composite nonwoven textile of claim 1 further comprising, a second fiber web comprising a machine direction, a cross direction, a thickness, third fibers, and fourth fibers, wherein:

the third fibers, as compared to the fourth fibers, comprise a higher amount of the ERA material;

the second fiber web comprises a substantially homogenous blend of third fibers to fourth fibers distributed in one or more of the machine direction, the cross-machine direction, and the thickness of the second fiber web; and the second fiber web comprises a plurality of amorphous polymer agglomerates that include material from one or more fibers of the third fibers encapsulating one or more fibers of the fourth fibers.

10. The composite nonwoven textile of claim 9, wherein at least some fibers of the first fiber web are entangled with at least some fibers of the second fiber web.

11. The composite nonwoven textile of claim 1 further comprising, an elastomeric layer, wherein the elastomeric layer and the first fiber web are mechanically entangled in the composite nonwoven textile.

12. The composite nonwoven textile of claim 1, wherein the composite nonwoven textile comprises at least a portion of a wearable article, and wherein the first fiber web comprises at least one of an outermost surface of the wearable article or an innermost surface of the wearable article.

13. The composite nonwoven textile of claim 1, wherein at least some the first fibers are cross-lapped with the second fibers and comprise at least portions oriented at a first angle relative to the machine direction of the first fiber web and in a range of about 30 degrees to about 60 degrees.

14. The composite nonwoven textile of claim 1, wherein the first fibers and the second fibers are associated with a blend of first fibers to second fibers that is highly homogenous.

15. The composite nonwoven textile of claim 1, wherein the plurality of amorphous polymer agglomerates comprises first amorphous polymer agglomerates comprising a first property and second amorphous polymer agglomerates comprising a second property; and wherein the first amorphous polymer agglomerates are different from the second amorphous polymer agglomerates based on the first property and the second property.

16. A composite nonwoven textile comprising:

a first fiber web comprising first fibers and second fibers, wherein:

the first fibers, as compared to the second fibers, comprise a higher amount of an ERA material; and the first fiber web comprises first amorphous polymer agglomerates that include material from one or more fibers of the first fibers encapsulating one or more fibers of the second fibers; and a second fiber web that comprises third fibers and fourth fibers, wherein:

the third fibers, as compared to the fourth fibers, comprise a higher amount of the ERA material;

the second fiber web comprises second amorphous polymer agglomerates that include material from one or more fibers of the third fibers encapsulating one or more fibers of the fourth fibers; and the second fiber web comprises, as compared to the first fiber web, a higher amount by weight of the ERA material.

17. The composite nonwoven textile of claim 16, wherein the third fibers compositionally comprise a higher amount of the ERA material as compared to the first fibers.

18. The composite nonwoven textile of claim 16, wherein a percentage by weight of the first fiber web comprised of the first fibers is less than a percentage by weight of the second fiber web comprised of the third fibers.

19. The composite nonwoven textile of claim 16 further comprising, an elastomeric layer coupled, wherein the elastomeric layer, the first fiber web, and the second fiber web are mechanically entangled in the composite nonwoven textile.

20. The composite nonwoven textile of claim 16, wherein the composite nonwoven textile comprises at least a portion of a wearable article; and wherein the first fiber web comprises an outermost surface of the wearable article or an innermost surface of the article of apparel.

21. The composite nonwoven textile of claim 16, wherein a relative difference between a quantity of first amorphous polymer agglomerates and a quantity of second amorphous polymer agglomerates is less than a relative difference between an amount by weight of ERA material in the first fibers and an amount by weight of ERA material in the second fibers.

22. A composite nonwoven textile comprising:

a machine direction, a cross-machine direction, and a thickness;

first fibers and second fibers, wherein the first fibers, as compared to the second fibers, comprise a higher amount of an ERA material; and a substantially homogenous distribution of amorphous polymer agglomerates in one or more of the machine direction, the cross-machine direction, and the thickness, wherein the amorphous polymer agglomerates comprise material from one or more fibers of the first fibers encapsulating one or more fibers of the second fibers;

wherein the substantially homogenous distribution is in the machine direction and in the cross-machine direction.

23. The composite nonwoven textile of claim 22, wherein the substantially homogenous distribution is continuous through the thickness from a first face of the composite nonwoven textile to an opposing second face of the composite nonwoven textile.

24. The composite nonwoven textile of claim 22, wherein the composite nonwoven textile comprises a first fiber web entangled with a second fiber web.

25. The composite nonwoven textile of claim 22 further comprising, an elastomeric layer, wherein the elastomeric layer is mechanically entangled in the composite nonwoven textile.

26. The composite nonwoven textile of claim 22, wherein the substantially homogenous distribution of amorphous polymer agglomerates is based on a density across regions of interest.

27. The composite nonwoven textile of claim 26, wherein the substantially homogenous distribution is highly homogenous.

28. The composite nonwoven textile of claim 1, wherein the amorphous polymer agglomerates comprise first amorphous polymer agglomerates comprising a first property and second amorphous polymer agglomerates comprising a second property; and wherein the first amorphous polymer agglomerates are different from the second amorphous polymer agglomerates based on the first property and the second property.

* * * * *